US006099080A

United States Patent [19]

Hirashita et al.

[11] Patent Number: 6,099,080

[45] Date of Patent: Aug. 8, 2000

[54] DRY CUTTING AND GROOVING APPARATUS FOR PAVEMENT

[75] Inventors: Kenji Hirashita, Sayama; Takao Yamamoto, Onojo, both of Japan

[73] Assignee: Nippon Fureki Industrial Co., Limited, Tokyo, Japan

[21] Appl. No.: 09/049,344

[22] Filed: Mar. 27, 1998

[30] Foreign Application Priority Data

Mar. 31, 1997 [JP] Japan ..... 9-081213

[51] Int. Cl.[7] ..... E01C 23/09

[52] U.S. Cl. ..... 299/39.3; 404/93; 125/13.01; 451/352; 451/450; 451/456

[58] Field of Search ..... 299/39.1, 39.2, 299/39.3, 39.4; 404/89, 91, 93; 125/13.01; 451/449, 450, 352, 456

[56] References Cited

U.S. PATENT DOCUMENTS

| | | | |
|---|---|---|---|
| 3,598,446 | 8/1971 | Hatcher | 299/39.1 |
| 3,923,341 | 12/1975 | Miller | 299/39.1 |
| 4,022,182 | 5/1977 | Lenkevich | 125/13.01 |

FOREIGN PATENT DOCUMENTS

| | | |
|---|---|---|
| 3912885 | 10/1990 | Germany . |
| 5741168 | 3/1982 | Japan . |
| 59-152063 | 8/1984 | Japan . |
| 1743824 | 6/1992 | U.S.S.R. . |
| 790480 | 2/1958 | United Kingdom . |
| 1112132 | 5/1968 | United Kingdom . |
| 2122534 | 1/1984 | United Kingdom . |
| 87/00222 | 1/1987 | WIPO . |

*Primary Examiner*—Eileen Dunn Lillis
*Assistant Examiner*—Sunil Singh
*Attorney, Agent, or Firm*—Griffin & Szipl, P.C.

[57] ABSTRACT

In a dry cutting and grooving apparatus for pavement in which blades for cutting or grooving the pavement are covered by a housing which leaves the lower ends of the blades exposed, and in which chips and cutting powder generated at the time of cutting and grooving operation by the blades are collected by a suction means connected to the housing, air is forcibly supplied to the housing and the dust stored within the housing is quickly scavenged by the air flow toward the suction end. Further, by providing an air supply passage within the main shaft of the blades and discharging the air from the surface and the outer periphery of the blades, the dust within the housing is scavenged in the same manner while the tips of the blades can be cooled by the discharged air.

6 Claims, 21 Drawing Sheets

DRY CUTTING AND GROOVING APPARATUS FOR PAVEMENT

BACKGROUND OF THE INVENTION

1. Field of the Invention

The present invention relates to a dry cutting apparatus for pavement when constructing sewerage or underground gas pipes, for example, and to a road processing apparatus such as a grooving apparatus for making a plurality of grooves in order to prevent vehicles on a road from slipping and, more particularly, to a dry cutting and grooving apparatus for pavement structured so as to quickly collect and remove chips and cutting powder in order to improve cutting efficiency.

2. Description of Related Art

Conventionally, there have been known a road cutting apparatus for linearly cutting a surface of a pavement and a grooving apparatus for making a multiplicity of grooves on a curve or a steep slope of a general road, and pavement of an airport.

These road cutting apparatus and the grooving apparatus are provided with a diamond blade as a member for cutting and grooving, and the basic structure thereof is to rotate the diamond blade at a high speed and to cut the pavement by moving the blade into the pavement.

Among these road cutting apparatuses and the grooving apparatus, a so-called wet-type apparatuses which supplies water for removing chips and cutting powder as well as for cooling the diamond blade during operation, has been mainly used. However, since the chips and cutting powder are mixed into the supplied water and flow onto pavement, the pavement becomes soaked with the polluted water. Thus, it has been necessary to collect and remove the water after operation.

Further, when cutting and grooving pavement with a diamond blade, it is considered more important to remove chips and cutting powder from the surface of the blade than to cool down the blade.

Namely, since chips and cutting powder accumulating during the operation with the passage of time enter into an area between the processed surface and the blade, it is unavoidable to generate heat in the blade due to friction between these interposing substances and the blade. Therefore, the chips and cutting powder should be removed. When chips and cutting powder are not positively removed, the blade is bent due to heating of the blade so that cutting efficiency is widely lowered and the cut surface is deteriorated due to deformation, thereby inviting inferior processing.

On the other hand, in place of this wet-type processing, a dry-type processing in which no water is supplied has also been known. A road cutting apparatus and a grooving apparatus used for the dry process are provided with an air suction mechanism for collecting dust in a housing which covers around the blade.

FIG. 23 is a schematic view which shows a main portion of a structure for sucking chips and cutting powder from the housing in a conventional apparatus.

An illustrated example shows an apparatus for cutting pavement, wherein a housing 52 surrounding a periphery of a blade 51 which includes diamond abrasive grains and is connected to a drive mechanism disposed in a body of a cutting apparatus is integrally mounted to the body end, and a duct 53 for sucking is disposed in front of the housing 52. The duct 53 is connected to a vacuum pump disposed in the body end.

The blade 51 rotates clockwise in the drawing which is the same direction as the rotating direction of a wheel when the body is running, and linearly cuts a paved portion on the road by this rotation.

When a suction port of the duct 53 is open to the front portion of the housing 52 in a manner mentioned above, it is possible to collect chips and cutting powder generated during cutting by sucking up them.

However, although a part of fine particles within the housing 52 is sucked into the duct 53, the fine particles are likely to touch both surfaces of the blade 51 and tend to be forced by swirling flow in the same direction as the rotating direction of the blade caused by the blade 51 itself. Particularly, when the blade 51 rotates at a high speed, a swirling force to the same direction as the rotating direction of the blade 51 is applied to the fine particles including the chips and the cutting powder.

Accordingly, the fine particles within the housing 52 do not simply float, but they are given fluidity by a high-speed rotation of the blade 51, so that a suction force of the duct 53 is reduced. Particularly, in a portion corresponding to a suction port of the duct 53, since the fine particles swirl downward, the fine particles go to the direction opposite to the sucking direction of the duct 53, so that sucking efficiency of the duct 53 is widely lowered.

As mentioned above, despite the suction duct 53 provided in the housing 52, the fine particles such as chips and cutting powder are forcibly fluidized by influence of the high-speed rotation of the blade 51, and thus the fine particles are scattered from the housing 52. Further, since the blade 51 is heated up by such fine particles entering between the blade 51 and a processed surface of the pavement, which leads to low efficiency and deterioration of the processed surface.

On the contrary, in the grooving apparatus for simultaneously cutting a plurality of grooves on pavement for preventing slippage, for example, since a multiplicity of blades are disposed on the same axis to form the grooves, more fine particles are generated in comparison with pavement cutting. Furthermore, since the generated fine particles are fluidized in a portion between a pair of blades, not a single blade, disposed at an interval, a fluidizing force due to a forcible swirling flow mentioned above are larger, which lowers efficiency of collecting the fine particles by the duct.

A diamond wheel having diamond abrasive grains on the peripheral surface as a segment is used for the blade 51. In this case, a cutting surface of the wheel is gradually worn as an operation time becomes longer. Accordingly, the blade 51 has to be frequently replaced and is often replaced at the construction site.

However, since the blade 51 is rotated at a high speed, and also resistance of the pavement when cutting is large, the rigidity of a fixing structure to an apparatus body for cutting or grooving pavement must be high. Thus, the structure of a member for supporting the blade 51 is complex, and it requires a lot of time to remove the main rotation shaft for the blade 51 from the apparatus body and to reassemble the main rotation shaft. For example, when the blade 51 is a single blade as in the illustrated example, an operation time interrupted by replacement is not much; however, in the case of the grooving apparatus in which a plurality of blades for simultaneously cutting a multiplicity of grooves for preventing slippage are coaxially disposed, a replacing operation requires a long time due to the large number of the blades.

As mentioned above, in cutting and grooving pavement in accordance with the conventional dry-type process, although there are some advantages that contaminated water is not generated and a cleaning operation is not required, it cannot be avoided that the environment is deteriorated due to scattered fine particles outside and cutting efficiency is lowered due to heat generation and deformation of the blade caused by the fine particles entering into the processed surface. Further, since the replacing operation of the blade is complex and requires a lot of time, there is a problem that operation efficiency is further lowered.

SUMMARY OF THE INVENTION

An object of the present invention is to more effectively prevent fine particles generated when cutting and forming grooves by a blade from scattering outside, to prevent heat generation and deformation of the blade so as to effectively cut and groove pavement, and to replace the blade in a short time.

In accordance with an apparatus of the invention, there is provided a dry cutting and grooving apparatus for pavement comprising a body provided with a drive means, a single or a plurality of rotatable blades for cutting or grooving driven by the drive means, and a housing to cover all of the blades except at least the lower-end portions thereof, wherein the blade rotates in a direction to scrape out and bring up the pavement layer toward the front end of the body, the housing is provided with scavenging means comprising a combination of an air supply means and a suction means, the air supply means allows the pressurized feeding of air to flow along both sides of the blade in the housing, and the suction means communicates with the housing to suck air along with dust particles through a port provided at the downstream end of the housing.

In this structure, the dust particles generated when cutting and grooving pavement can be quickly discharged to the suction mechanism using air forcibly fed from the air supply mechanism, not by sucking air from the housing. Accordingly, the dust particles are prevented from scattering out of the housing.

In accordance with another embodiment of the invention, there is provided a dry cutting and grooving apparatus for pavement, wherein a single blade is provided for the cutting operation, the housing has an inner profile which provides an equal distance relationship between both sides of the blade and the corresponding opposed inner walls of the housing, the housing is also provided with an air supply port communicating with the air supply means, and an opening of the air supply port is located so as to face the outer periphery of the blade and to be substantially linearly symmetric with respect to the blade.

In this structure, an air flow between the blade and the housing is laminar, and can be introduced to the suction end while the dust particles are not attached to a tip portion of the blade.

In accordance with a further embodiment of the invention, there is provided a dry cutting and grooving apparatus for pavement, wherein the housing is provided with a longitudinal opening in one end surface thereof through which an end portion of a support shaft coaxially carrying the blade passes, the support shaft is connected to the drive means at a portion extending from the longitudinal opening thereof, whereby the housing is connected to the body in a way to allow the housing to move in a vertical direction, and the housing is also provided with a compensation opening in the other end surface thereof, the compensation opening occupies a cross-sectional area which is smaller than that of the longitudinal opening by a difference equaling the cross-sectional area of the support shaft.

In this structure, despite the opening for receiving the support shaft, the provided compensation hole enables air to be uniformly sucked toward the flow passage on both surfaces of the blade from the outer portion of the housing. Thus, the pressures in the flow passages which hold the blade therebetween cannot differ.

In accordance with a still further embodiment of the invention, there is provided a dry cutting and grooving apparatus for pavement, wherein the suction means includes a duct which is provided separately from the housing and whose suction inlet port opposes the periphery of the blade in the housing.

In this structure, although the housing and the duct are separately provided, the strong suction force toward the duct can prevent the dust particles from scattering, and the particles can be collected in the collecting unit.

In accordance with yet another embodiment of the invention, there is provided a dry cutting and grooving apparatus for pavement, wherein the housing is provided therein with a plurality of blades for grooving operations and a plurality of separators disposed between each adjacent blade for separating the internal space of the housing into a plurality of sections, the housing is also provided with an air supply header and a suction header at portions communicating with the air supply means and the suction means thereof, and the air supply header and the suction header protrude out from an accommodating space for the arrangement of the blades and separators and occupy at least the full length of the arrangement of the blades and separators.

In this structure, the dust particles are not scattered from the housing by means of air supply from the air supply header and air suction to the suction header, and can be collected in the collecting unit.

In accordance with another embodiment of the invention, there is provided a dry cutting and grooving apparatus for pavement, wherein the housing is provided with a longitudinal opening in one end surface thereof through which an end portion of the support shaft coaxially carrying the blades passes, the support shaft is connected to the drive means at a portion extending from the longitudinal opening thereof, the separator is provided with an aperture for assembly through which the support shaft passes and of which the inner diameter is larger than the outer diameter of the support shaft so as to form an annular gap between the inner periphery of the aperture and the outer periphery of the supporting shaft, whereby the housing is connected to the body in a way to allow the housing to move in a vertical direction, the housing is also provided with a compensation opening in the other end surface thereof, and the compensation opening occupies a cross-sectional area which allows suction air to flow therethrough to enter the housing so that the air flow rate from the compensation opening is substantially proportionate to that from the longitudinal opening.

In this structure, even when a plurality of blades are disposed, a disturbance of the air flow between the blades can be prevented by balancing the rate of the air flow into the housing.

In accordance with a further embodiment of the invention, there is provided a dry cutting and grooving apparatus for pavement, wherein the feed-air flow rate from the air supply means is less than the suction-air flow rate of the suction means.

In this structure, air can be more quickly scavenged from the housing by the larger amount of the sucked air than the amount of the pressure feeding air.

As mentioned above, in accordance with the invention, the dust particles generated when cutting and grooving pavement can be quickly discharged to the suction mechanism by forcibly feeding the air toward the suction mechanism by the air supply mechanism, not by sucking air from the housing, so that the dust particles can be prevented from being scattered from the housing. Additionally, the forcing of the dust particles to the suction mechanism end can be further promoted by scraping up the rotational direction of the blade with respect to the advancing direction of the apparatus, thereby effectively preventing the dust particles from being scattered to the outside of the housing.

Further, since the positional relationship between the blade and the housing are arranged so that the air flow within the housing is laminar, the air flow can be introduced into the suction end without attaching the dust particles to the tip portion of the blade. Therefore, the blade is not heated during the cutting and grooving operation, and the deformation of the blade can also be prevented. Consequently, an efficient cutting can be maintained, and good processed surface and groove for preventing slippage can be obtained.

Further, in accordance with another embodiment of the invention, there is provided a dry cutting and grooving apparatus for pavement comprising a body provided with a drive means, a single or a plurality of disc-shaped blade members for cutting or grooving which are coaxially disposed and are driven by the drive means, and a housing which covers all of the blade members except the lower-end portions thereof, wherein the blade member is provided with an air flow passage communicating with the air supply means and discharging the supplied air therefrom, and the housing is provided with a sucking means which scavenges the air along with dust particles and removes them from the housing.

In this structure, the air flow can be diffused to the radial direction of the blade by a high speed rotation of the rotating blade when discharging the air from the rotating blade itself, so that the dust particles near the processed surface can be discharged to the suction end.

In accordance with a still further embodiment the invention, there is provided a dry cutting and grooving apparatus for pavement, wherein the blade member comprises a pair of base plates disposed in the axial direction interposing an interval for the air flow passage therebetween and a single or a plurality of cutting tips provided on an outer periphery thereof, and the air flow passage is provided with openings for discharging the air along with dust particles, disposed in at least one end or the outer periphery of the blade member.

In accordance with yet another embodiment of the invention, there is provided a dry cutting and grooving apparatus for pavement, wherein the blade member comprises a pair of blades with tips integrally attached to the outer periphery thereof, the blades are disposed in the axial direction interposing an interval for an air flow passage therebetween, the air flow passage is provided with openings for discharging the air along with dust particles, disposed in at least one end or the outer periphery of the blade member.

In accordance with a still further embodiment of the invention, there is provided a dry cutting and grooving apparatus for pavement, wherein the housing is provided with a main shaft rotatably connected to the drive means therein, the main shaft carries the blade member in a fixable manner therearound and is provided with an air supply passage communicating with the air supply means therein, and the air supply passage communicates with the air flow passage of the blade member.

In the above embodiment of the invention, the main shaft for holding the blade or the blade layered body can be also used for supplying air.

In accordance with another embodiment of the invention, there is provided a dry cutting and grooving apparatus for pavement, wherein the main shaft is provided with a swivel joint at one end in the axial direction thereof with which the air supply means communicates.

In this structure, even when the main shaft is rotated at a high speed, air can be smoothly supplied to the blade or the blade layered body.

In accordance with a still further embodiment of the invention, there is provided a dry cutting and grooving apparatus for pavement, wherein the main shaft is provided with an annular spacer in a fixable manner therearound, the spacer has an outer diameter which is smaller than the outer diameter of the blade member and interposes an interval between each adjacent blade member, and the spacer is provided with a flow passage which communicates with both the air supply passage in the main shaft and the air flow passage in the blade member.

In this structure, the spacer can be used not only for holding the interval between the blades or the blade layered bodies but also for an air supply member.

In accordance with another embodiment of the invention, there is provided a dry cutting and grooving apparatus for pavement, wherein the air supply passage of the main shaft includes a flow passage groove which is formed on an outer periphery of the main shaft in the axial direction thereof, the spacer is provided with an attachment opening through which the main shaft is inserted, a recessed portion formed in a spot-facing manner surrounding the attachment opening, a flow inlet opening formed in a region included in and corresponding to the recessed portion when the spacer and the blade member overlap each other, whereby the flow inlet opening communicates with the air flow passage in the main shaft, and a flow outlet opening communicating with the air flow passage formed at a position apart from the outer periphery of the spacer.

In this structure, the air flow passage can be obtained only by adjusting the relation between the spacer, the flowing-in hole and the flowing-out hole.

In accordance with a further embodiment of the invention, there is provided a dry cutting and grooving apparatus for pavement, wherein the body is provided with a first bearing and a second bearing for rotatably supporting the main shaft at the both ends in the axial direction thereof, the first bearing is fixed to the body and supports the main shaft at one end thereof which is connected to the drive means, the second bearing supports the main shaft at the other end thereof and is removable from both the body and the main shaft, whereby the second bearing can be removed to leave the main shaft behind with the body.

In this structure, the blade or the blade layered body and the spacer can be replaced only by removing the second bearing without detaching the first bearing in the body of the apparatus.

In accordance with a still further embodiment of the invention, there is provided a dry cutting and grooving apparatus for pavement, wherein the main shaft is provided with a first flange therearound which opposes the first bearing, the second bearing is provided with a hollow supporting shaft coaxially inserted thereinto, whereby the supporting shaft is connected to and communicating with the swivel joint, the supporting shaft is provided with a second flange which engages with one end of the main shaft in a spline combination, and the blade member and the spacer arrangement is interposed between the first and second flanges to be tightly bound with pressure loading by the first and second flanges.

In this structure, since the blade or the blade layered body and the spacer can be secured by the first and second flanges, it is unnecessary to firmly fix the blade and the spacer to the main shaft. Thus, these members can be easily attached and detached.

In accordance with a further embodiment of the invention, there is provided a dry cutting and grooving apparatus for pavement, wherein the first flange is provided with a plurality of connecting rods disposed parallel to the main shaft with a distal free end thereof, the blade or the layered blades and the spacer are provided with apertures for inserting the connecting rods therethrough, and the distal end of the connecting rod is engagingly and detachably connected to the second flange.

In this structure, a simple structure can be realized by pushing and fixing the second flange with a nut which engages with a male screw provided in the tip portion of the connecting rod.

As mentioned above, in accordance with the above embodiments of the invention, air can be discharged from the rotating blade itself composed of the blade or the blade layered body, and can be diffused to a radial direction within the housing. Thus, the dust particles can be efficiently introduced to the suction end by an air flow along the rotating blade, and a desirable environment for operation with no leakage of the dust particles from the housing can be obtained. Additionally, since the air flow also effects the cutting surface of the rotating blade, the cutting surface can be cooled by the air, which leads to improved durability of the rotating blade and good quality of the processed surface of the pavement. Further, since the rotating blade and the spacer can be replaced by removing only the second bearing without detaching the first bearing in the body, a replacing operation in a construction site can be simplified. Particularly, the blade and spacer which are secured by the first and second flanges are not required to be firmly fixed to the main shaft. Thus, the replacing operation is greatly facilitated.

BRIEF DESCRIPTION OF THE DRAWINGS

FIGS. 6A and 6B are views which show an end surface in both sides of the housing, in which FIG. 6A shows an aperture for passing a support shaft and FIG. 6B shows a compensating aperture;

FIGS. 15A and 15B show details of the blade, in which FIG. 15A is a front elevational view and FIG. 15B is a cross sectional view which shows a main portion with a partly enlarged view;

FIGS. 19A and 19B show details when the blade shown in FIG. 18 is attached to the main shaft, in which FIG. 19A is a vertical cross sectional view which shows a main portion together with an air flow, and FIG. 19B is a vertical sectional view which shows a main portion of an air discharge from a second discharge port;

FIGS. 20A and 20B show details of the air discharge port in the blade shown in FIG. 18, in which FIG. 20A shows a first discharge port and FIG. 20B shows a second discharge port;

FIGS. 22A and 22B show details when the blade and the spacer plate shown in FIG. 11 are attached to the main shaft, in which FIG. 22A is a vertical cross sectional view which shows a main portion together with an air flow, and FIG. 22B is a perspective view which shows an air discharge from the segment notch portion.

DESCRIPTION OF THE PREFERRED EMBODIMENTS

FIGS. 1 to 10 show preferred embodiments of a cutting and grooving apparatus for pavement in accordance with the invention.

Figure 1:
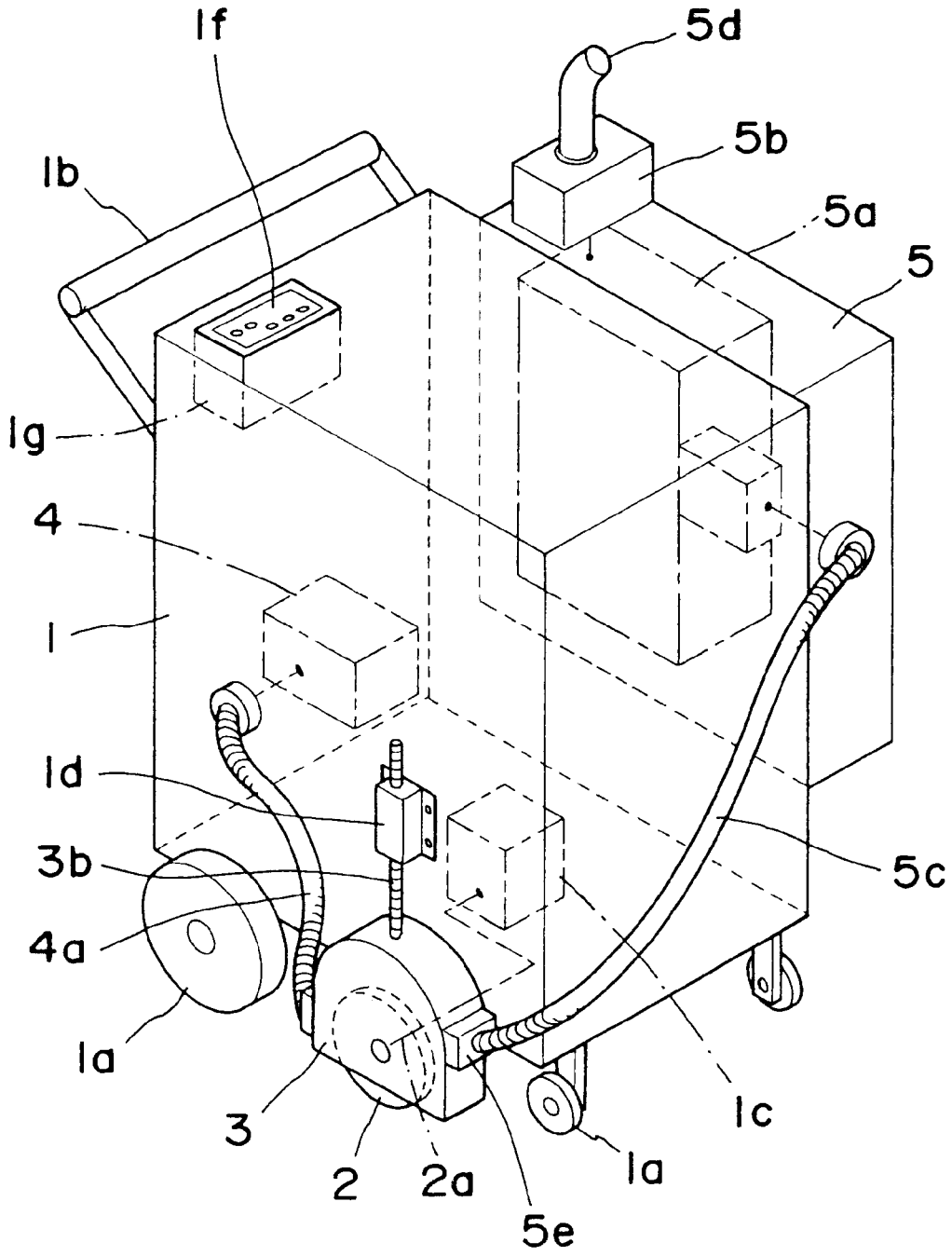
FIG. 1 is a perspective view which schematically shows a cutting apparatus in accordance with an embodiment of the invention in which a blade for cutting pavement is provided.

FIG. 1 is a schematically perspective view which shows an outline of a cutting and grooving apparatus for pavement, which is usable for cutting pavement.

In the drawing, four wheels 1*a* rolling on pavement are provided in a body 1 for a cutting and grooving apparatus, and an operator grips and pushes a grip 1*b* provided in a rear end of the body 1 to move the apparatus on the pavement.

A cutting blade 2 is rotatably provided in the lower end of the left side in the front view of the body 1 in the moving direction. The blade 2 is a conventional blade in which a cutting tip made of a super abrasive grain is connected to the peripheral surface thereof. The blade can be rotated at a predetermined rotating velocity by connecting a support shaft 2*a* coaxially connected in the center thereof to a driving apparatus 1*c* including a motor and a reduction gear installed in the body 1. Then, a housing 3 surrounding the blade except the lower end portion thereof and vertically movable with respect to the body 1 is disposed around the blade 2.

Figure 2:
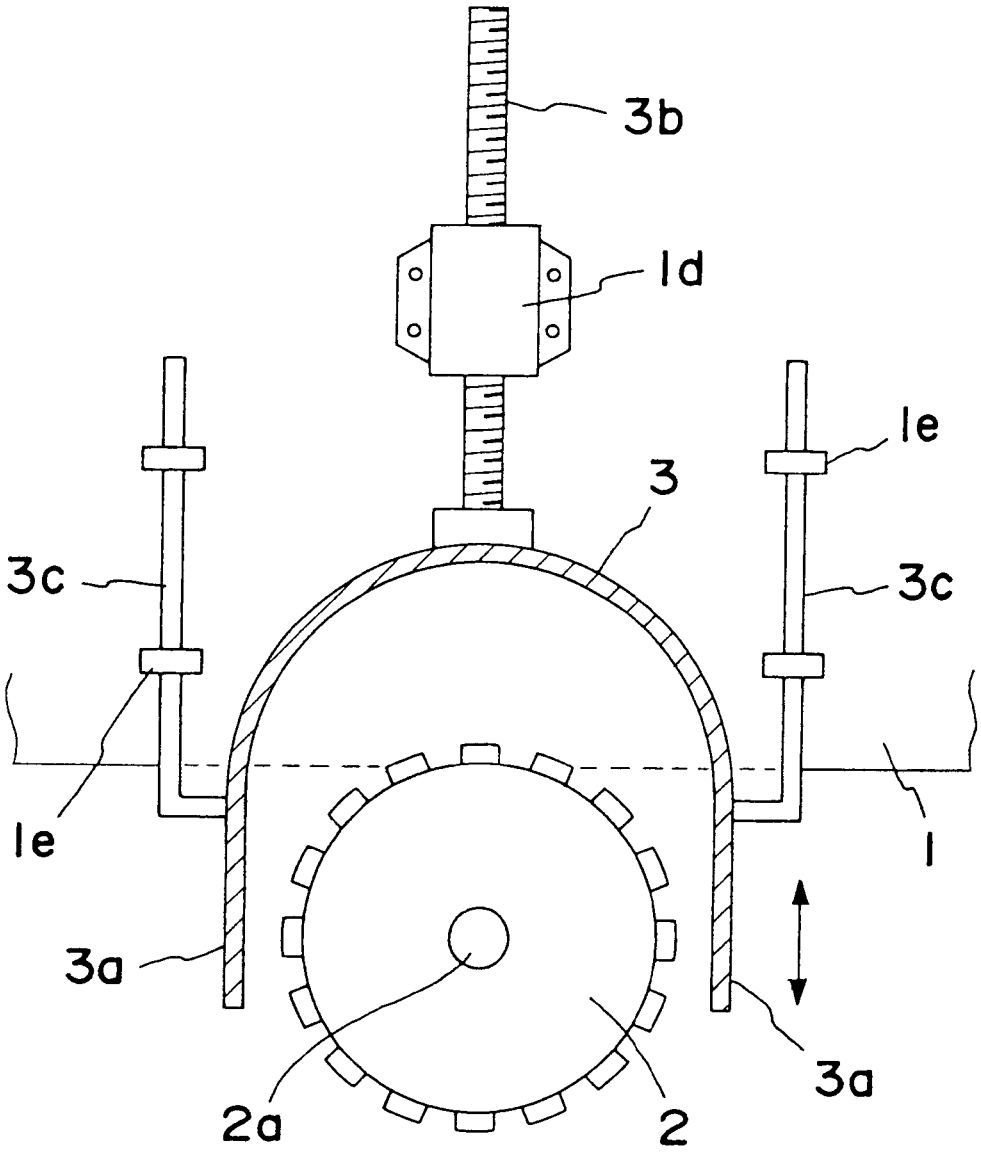
FIG. 2 is a front elevational view which schematically shows a main portion of a vertically elevating mechanism for a housing.
Figure 3:
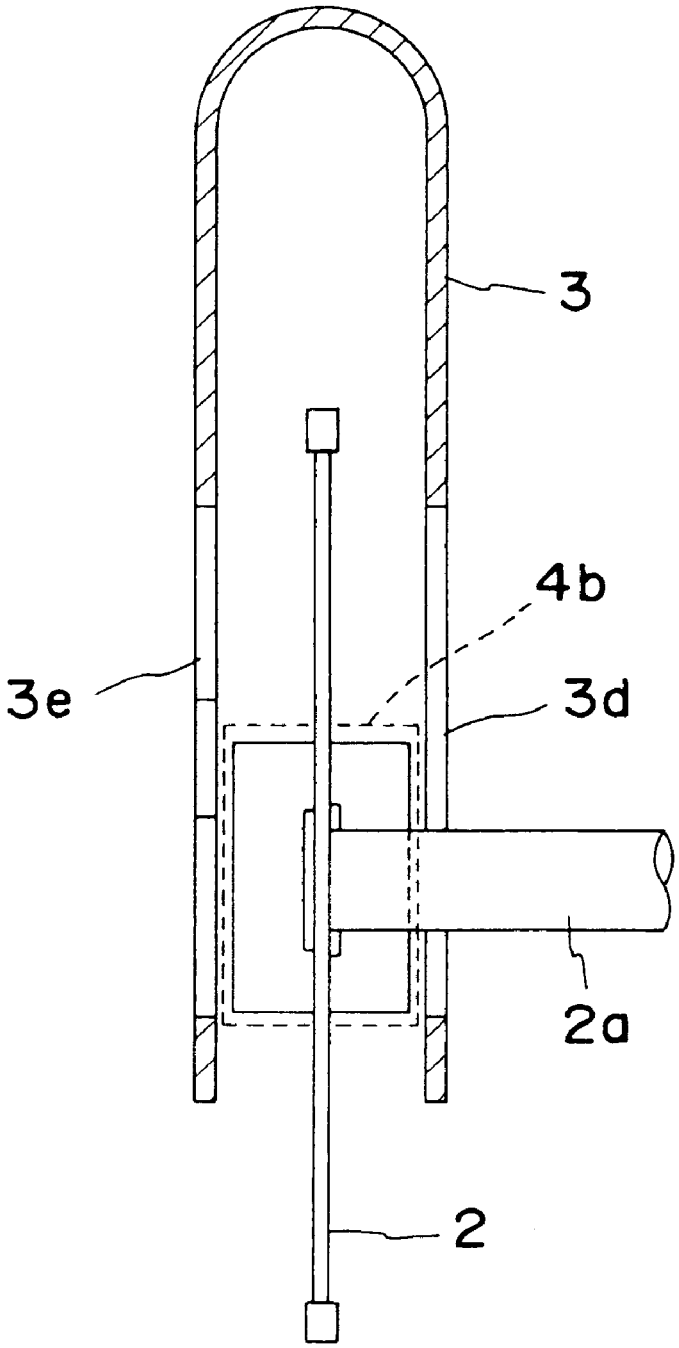
FIG. 3 is a vertical cross sectional view as seen from a front side of the apparatus which shows a main portion of the positional relationship between the housing and the blade.

FIG. 2 is a partially sectioned view which schematically shows an elevating mechanism for the housing 3 as seen in an axial direction of the support shaft 2*a* of the blade 2, and FIG. 3 is a vertical cross sectional view of a main portion which shows the positional relationship between the housing 3 and the blade 2.

The housing 3 has an upper half formed in a half circular arc shape and has a vertical cross sectional shape forming a skirt 3*a* vertically extending downward from both ends thereof, and a bolt 3*b* screwed in it length is connected to the upper end of the circular arc portion so as to be rotatable around an axis. A screw block 1*d* for screwing and passing the bolt 3*b* therethrough is fixed to the side surface of the body 1, and a pair of guide blocks 1*e* are arranged in the right and left portions of the screw block 1*d* on both upper and lower sides. These guide blocks 1*e* have, for example, a concave flat shape, and are structured so as to insert two guide rods 3*c* raised from the right and left ends of the housing 3 into a space between the concave portion and the side surface of the body 1. In FIG. 1, the guide block 1*e* and the guide rod 3*c* are omitted in order to simplify the figure.

Since the position of the housing 3 with respect to the body 1 is restricted by the guide rod 3*c* as mentioned above, the housing 3 can be elevated in accordance with a rotational direction of the bolt 3*b* by a screw-gear mechanism between the bolt 3*b* and the screw block 1*d* when the bolt 3*b* is rotated manually.

Returning to FIG. 1, in order to collect chips and cutting powder generated when cutting pavement by the blade 2, compressed air is supplied to the housing 3 while a suction system for sucking the dust from an inner portion of the housing 3 is connected to the housing 3.

The compressed air is supplied by a compressor 4 as an air supplier installed in the body 1 through a supply hose 4*a* such as a flexible tube having one end communicating with the compressor 4 and the other end connected to the housing 3. The dust and the air from the inner portion of the housing 3 is sucked by a collecting unit 5 disposed in the opposite side to the body 1. The collecting unit 5 is provided with a collecting chamber 5*a* for the dust in the inner portion thereof, and the flow passage from the collecting chamber 5*a* is connected to the suction fan 5*b* disposed in the upper portion of the collecting unit 5. The collecting chamber 5*a* and the housing 3 are connected by a collecting hose 5*c* such as a flexible tube, and the air from the housing 3 is sucked to the collecting chamber 5*a* by operating the suction fan 5*b*. Then, after collecting the dust within the collecting chamber 5*a*, the air is discharged from a discharge port 5*d* connected to an outlet of the suction fan 5*b*. The driving apparatus 1*c*, the compressor 4 and the suction fan 5*b* are operated by an operation table if with a controller 1*g* provided on the upper surface of the body 1.

Figure 4:
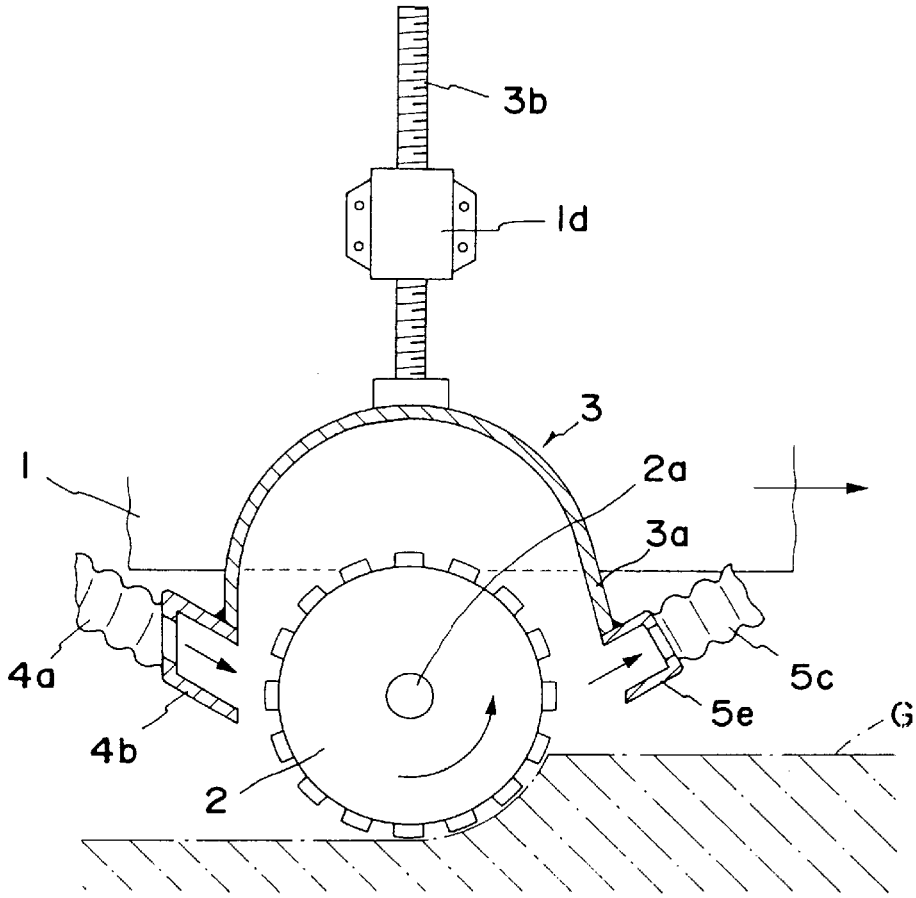
FIG. 4 is a vertical cross sectional view which shows a main portion of a connecting position of adapters connected to the housing for supplying and sucking air.
Figure 5:
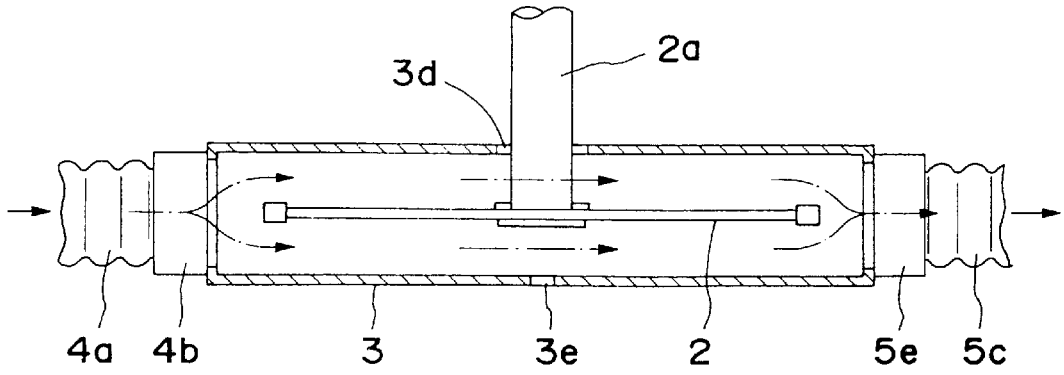
FIG. 5 is a horizontal cross sectional view which shows the positional relationship between the housing and the blade.

FIG. 4 is a vertical cross sectional view of a main portion which shows a connecting state of the supply hose 4*a* and the collecting hose 5*c* to the housing 3 and the positional relationship with respect to the blade 2, and FIG. 5 is a horizontal cross sectional view of the main portion. Although a skirt 3*a* on the right side of the housing 3 is slightly opening in an embodiment shown in FIG. 4, it may be formed in a linear shape as shown in FIG. 2.

In the distal end of the supply hose 4*a*, a cylindrical adapter 4*b* for connecting the supply hose 4*a* to the housing 3 is provided, and the adapter 4*b* is integrally provided in the housing 3 in such a manner that an axis thereof is directed to an inclined downward direction and is positioned on a center line of an internal space of the housing 3 as shown in FIG. 5. In the proximal end of the collecting hose 5*c*, a cylindrical adapter 5*e* having the same structure as above is provided and is connected to the housing 3 at a position in which an axis is disposed on the same axis as that of the adapter 4*b* of the supply hose 4*a* as shown in FIG.5 and in a state of being directed to an upward direction as shown in FIG. 4.

FIG. 5 shows the positional relationship between the housing 3 and the blade 2. The blade 2 is positioned so as to correspond with the center in a width direction of the housing 3, and the distance between both end surfaces of the blade 2 and the inner wall surface of the housing 3 opposing thereto is substantially equal to each other. Accordingly, a cross section of the flow passage formed between each surface of the blade 2 and the inner wall of the housing 3 can substantially be equal to each other. Thus, a flow velocity in the both flow passage cross sections can be made uniform.

Figure 6A:
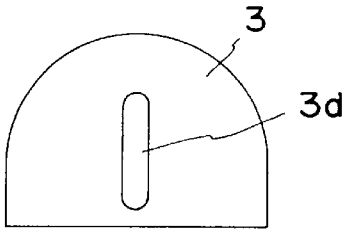

Further, in order that the housing 3 surrounding the blade 2 can vertically move, it is necessary to form a longitudinal opening 3*d* which is longer in the vertical direction as shown in FIG. 6A because the support shaft 2*a* extends through the surface of one end in the width direction of the housing 3. However, when the longitudinal opening 3*d* is provided, air is sucked from an outer portion of the housing due to the high-speed air flow within the housing 3, which would adversely affect the above-mentioned structure for uniforming the flow speed of the air in the passages on both sides of the blade.

Figure 6B:
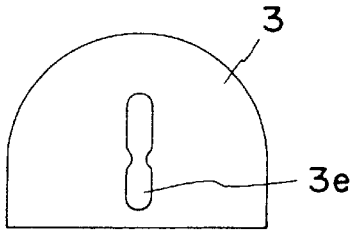

In order to solve this imbalance, a compensation opening 3*e* is provided on the opposing surface of the housing 3 in the position which corresponds to the longitudinal opening 3*d* as shown in FIG. 6B. The compensation opening 3*e* is made smaller than the longitudinal opening 3*d* for the same dimension as the cross section of the support shaft 2*a* extending through the longitudinal opening 3*d*, and is formed in a shape having a neck portion at a middle portion in the vertical direction.

As mentioned above, even when the longitudinal opening 3*d* is provided, the compensation opening 3*e* can realize the same condition in the flow passages on both sides of the blade 2, and the air flow passing through the flow passages is kept uniform.

In the structure mentioned above, a pavement G is cut after setting the level of the blade 2 with respect to the pavement G as shown in FIG. 4.

In this cutting operation, the driving apparatus 1*c*, the compressor 4 and the suction fan 5*b* are operated by the operating table 1*f*. While rotating the blade 2 to the direction of an arrow in FIG. 4 at a high speed, air is fed into the housing 3 from the compressor 4, and air containing the chips and the cutting powers is scavenged from the housing 3 by the suction fan 5*b* of the collecting unit 5.

Accordingly, as shown in FIG. 4, the blade 2 is rotated to the direction in which the blade tip on the periphery scrapes upward the layer of the pavement G, and the adapter 5*e* on the suction end is positioned substantially in front of the chips and cutting powder scattered upwardly by the scraping. Thus, in comparison with the case of the rotating direction of the blade as shown in the prior art, chips and cutting powder can be quickly collected. Further, since the compressed air from the compressor 4 presses out the air within the housing 3 in addition to the suction force due to the suction fan 5*b*, the air can be efficiently scavenged to the suction end, and the scattering of the dust outward the housing 3 can be securely prevented.

Further, as mentioned in FIG. 5, a turbulent flow around the blade 2 is prevented by unifying the air flow passing on the both surfaces of the blade 2, thereby putting the generated dust on the flow corresponding with the rotating direction of the blade 2. When the suction flow rate by the suction fan 5*b* is adjusted so as to be slightly larger than the pressing flow rate by the compressor 4, even in the case that the speed of the air in contact with the blade 2 is increased by the high speed rotation of the blade 2, the adapter 5*e* can securely hold the air flow to scavenge.

As mentioned above, the uniform air flow within the housing 3 prevents the generated chips and the cutting powder from accumulating on the cutting surface of the blade 2 and the pavement G, and prevents the dust from entering into the tip portion of the peripheral surface of the blade 2. Accordingly, the dust is not attached to the tip of the blade 2 or the surface near the tip, so that heat generation by the blade 2 can be controlled even in case of cutting with a high speed rotation. As a result, the blade 2 is prevented from bending and deforming, and a sharp cutting can be maintained, which leads to an efficient operation and a finely processed surface.

In FIG. 4, the skirt 3*a* of the housing 3 is opening outward and the adapter 5*e* in the suction end is provided in the lower end thereof. Alternatively, as shown in FIG. 1, the adapter 5*e* can be arranged in the upper end portion of the skirt 3*a*. In other words, on condition that the air containing the cutting powder is sucked and discharged at the same time when supplying the compressed air into the housing 3, the position of the adapter 5*e* may be optional.

Figure 7:
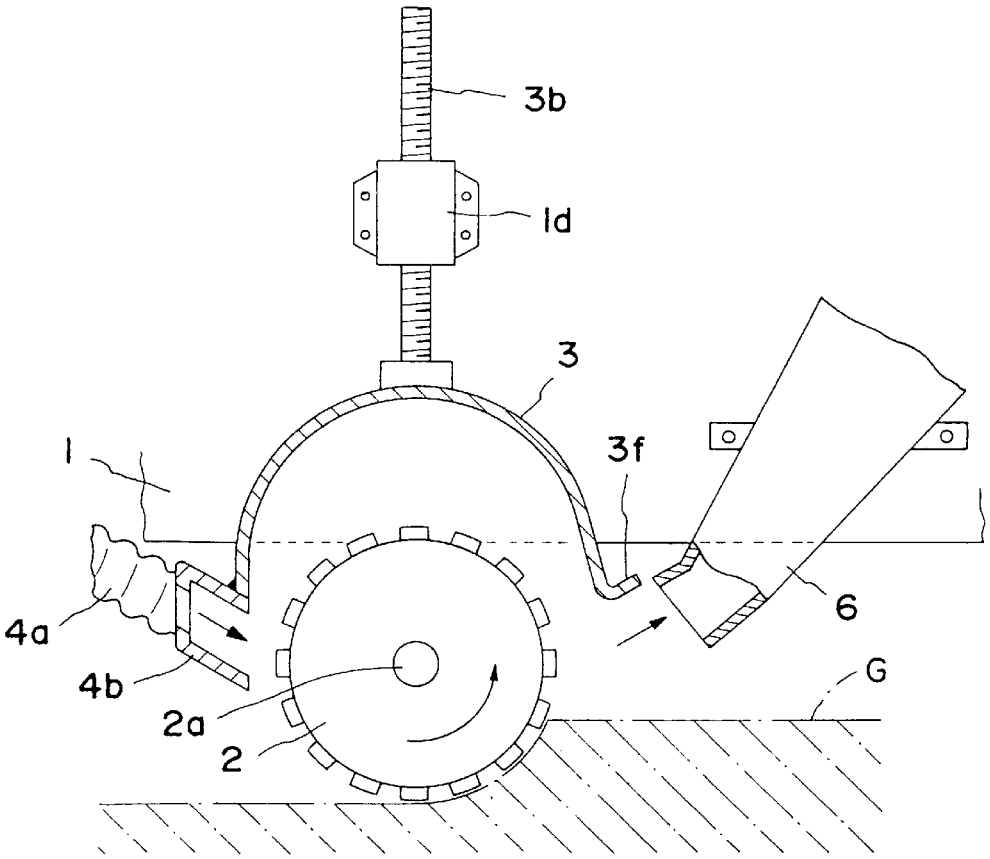
FIG. 7 is a cross sectional view which shows a main portion of an embodiment having a duct for suction in the body end separate from the housing.

The embodiment shown in FIG. 7 can be given as an example of the optionally positioned adapter 5*e* as mentioned above. This embodiment modifies the embodiment shown in FIG. 4 by cutting the skirt 3*a* on the side of the advancing direction slightly bending in a shape of a bell 3*f*, with the suction duct 6 being fixed to the body 1. In the duct 6, the flow passage thereof is connected to the suction fan 5*b* in the preceding embodiment, and the lower end is faced to the lower portion of the bell 3*f* of the housing 3.

In this structure, the air flow around the blade 2 can be uniformed by the housing 3 which is structured in the same manner as that shown in FIGS. 3 to 5, and the dust is prevented from being scattered and is sucked to the collecting unit 5 end by setting the suction force of the duct 6 slightly stronger than that in case of the above embodiment.

Figure 8:
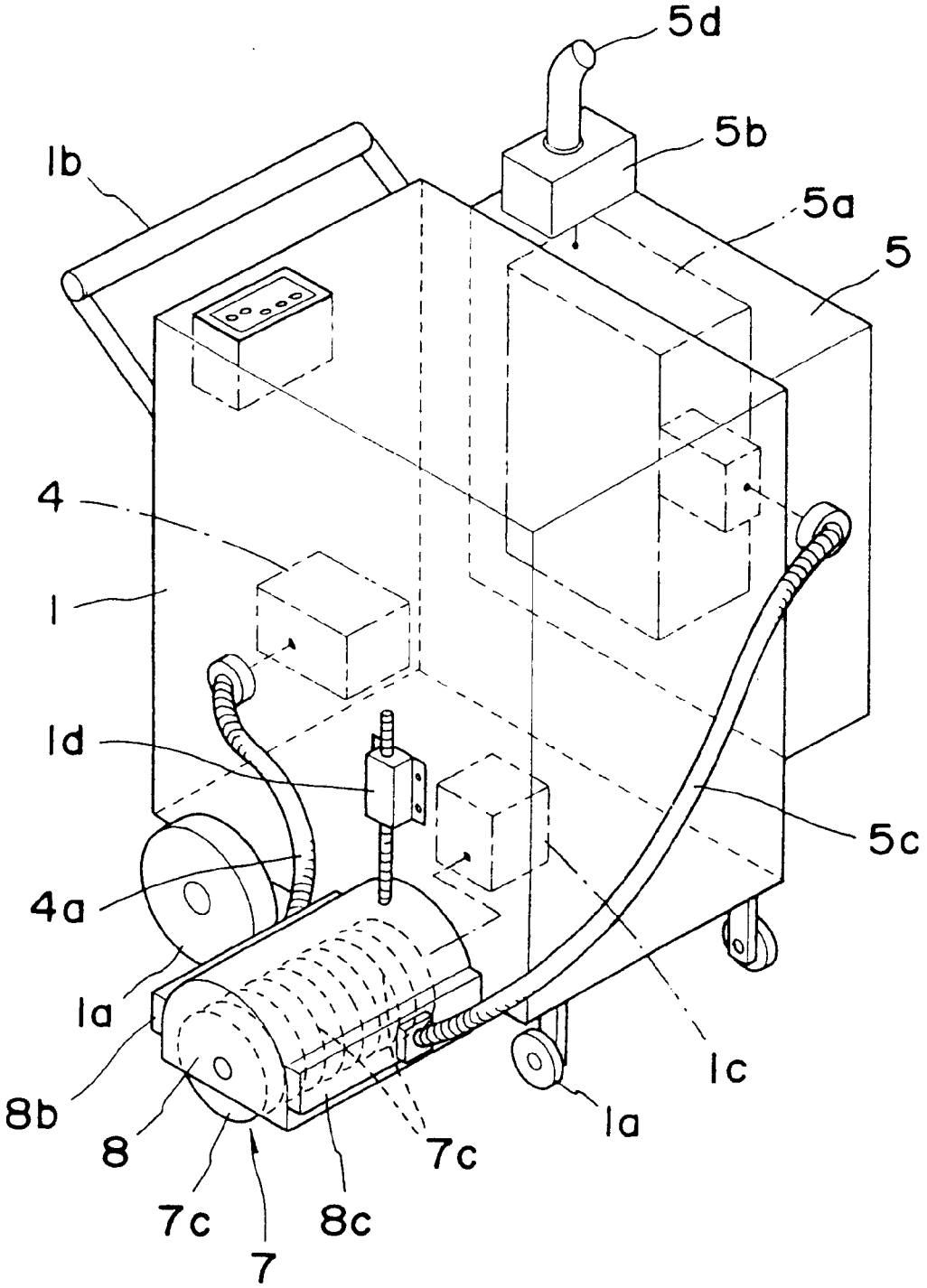
FIG. 8 is a perspective view which schematically shows a grooving apparatus in accordance with an embodiment of the invention which is provided with blades for grooving.

FIG. 8 is a schematic view illustrating an apparatus which can be used as a grooving apparatus. In this embodiment, the cutting blade 2 and the housing 3 in the body 1 in FIG. 1 can be replaced by a blade drum 7 and a housing 8 in use. In this case, the same and the common reference numerals are attached to the same elements as those shown in FIG. 1, and the detailed description thereof will be omitted.

Figure 9:
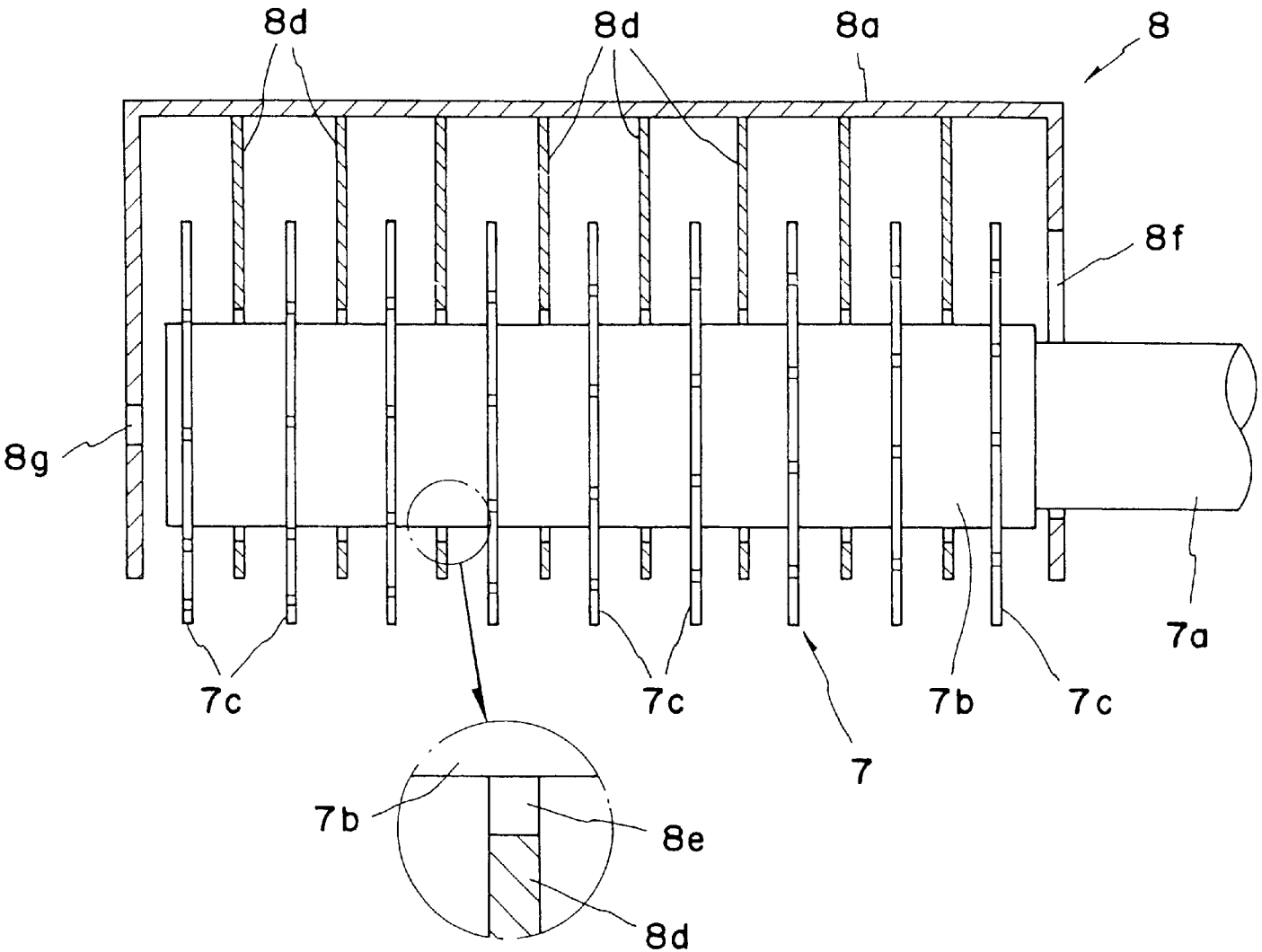
FIG. 9 is a vertical cross sectional view as seen from a front side of the body which shows a main portion of the positional relationship between a blade drum and the housing in the grooving apparatus shown in FIG. 8.
Figure 10:
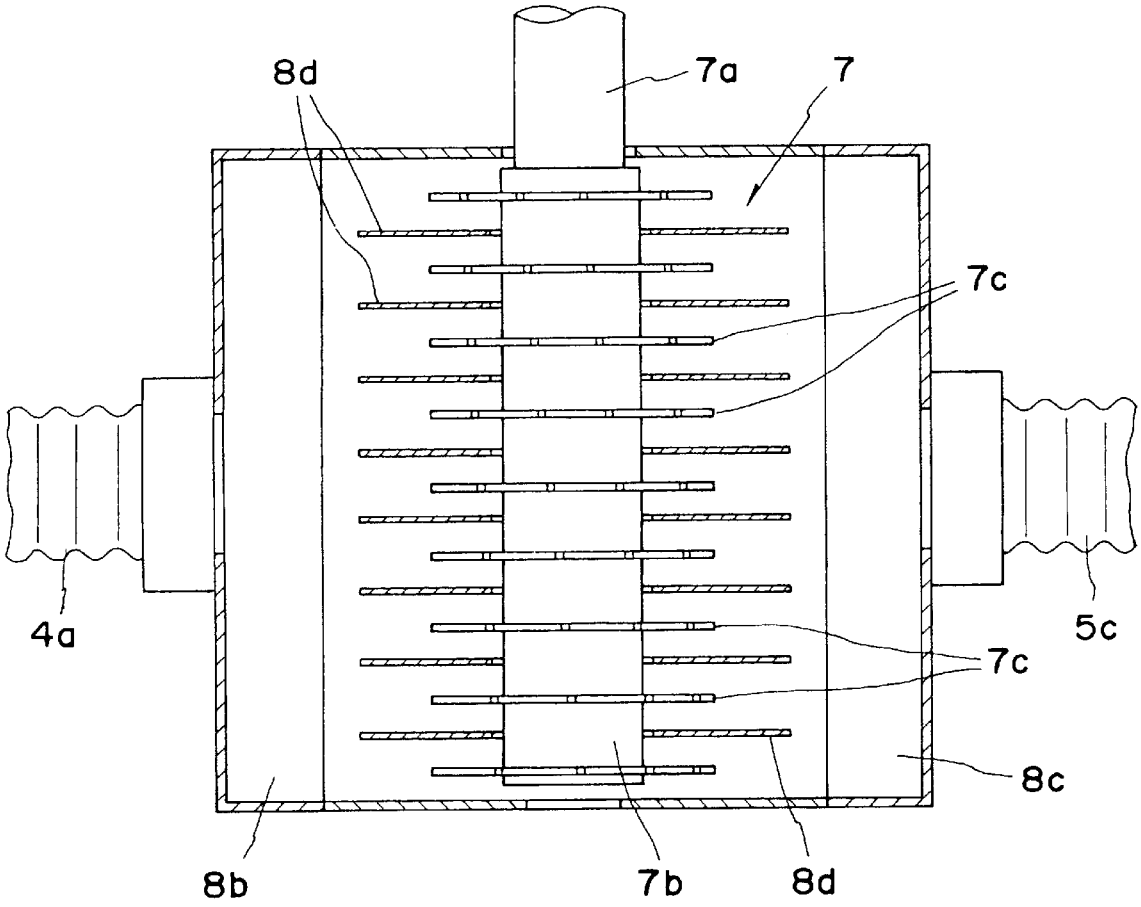
FIG. 10 is a horizontal cross sectional view of FIG. 9.

FIG. 9 is a vertical sectional view as seen from an advancing direction of the body 1 which shows a main portion cut by a plane including the axis of the blade drum 7, and FIG. 10 is a horizontal cross sectional view.

The blade drum 7 is mounted to the distal end of a support shaft 7*a* having a large diameter and connected to the output shaft of the driving apparatus 1*c*, and is constituted by a sleeve 7*b* outward fitted to the support shaft 7*a* and a multiplicity of blades 7*c* arranged on an outer periphery of the sleeve 7*b* at constant intervals.

The housing 8 is constituted by a chamber member 8*a* having a semicircular outer peripheral shape, an air supply header 8*b* and a suction header 8*c* which expands on the surfaces of both sides thereof, as shown in FIG. 8. The air supply and suction headers 8*b* and 8*c* are integrally formed in the full length in a longitudinal direction of the chamber member 8*a*, as shown in FIG. 10, and have an inner volume at a degree such that the air flow supplied to the internal space of the chamber member 8*a* can be uniformly distributed and supplied and the sucked air flow can be uniformly distributed and scavenged.

Separators 8*d* for partitioning each space between the blades 7*c* are provided within the chamber member 8*a*, as shown in FIGS. 9 and 10. The separators 8*d* are arranged in the middle of each space between the blades 7*c* as shown in the drawing, and an opening 8*e* having an inner diameter slightly larger than an outer diameter of the sleeve 7*b* with a gap between the hole and the sleeve is formed in the center portion thereof. Due to this arrangement of the separators 8*d*, the portion which is sectioned by a pair of right and left separators 8*d* sandwiching the blade 7*c* and the peripheral wall of the chamber member has the analogous structure to the relationship between the housing 3 and the blade 2 shown in FIG. 3 in accordance with the preceding embodiment.

Further, a longitudinal opening 8*f* having a width not interfering with the support shaft 7*a* is provided on both ends of the chamber member 8*a* of the housing 8 in order to vertically move the housing 8 in the same manner as that of the preceding embodiment. Further, a compensation opening 8*g* having a small diameter is provided in the other end of the housing 8 so that the air flow within the housing 8 is not affected by the longitudinal opening 8*f*.

Also in the structure where the blade drum 7 is covered with the housing 8, the compressed air from the compressor 4 is diffused within the air supply header 8*b* so as to be a uniform flow, thereby being supplied to the portions sectioned by the each of the separators 8*d* during grooving operation. The air flow passing though the portions between the separators 8*d* is temporarily damped because of the large space inside the suction header 8*c* and then smoothly collected in the collecting chamber 5. In this case, the rotating direction of the blade drum 7 is the same as the rotating direction of the blade 2 in the preceding embodiment.

Accordingly, even in the grooving apparatus having a multiplicity of blades 7*c*, since each air flow is uniformed between the blades 7*c*, a large amount of fine particles such as chips and cutting powder during grooving can be collected before affecting the blade tip portion of the blade 7*c*, so that the grooving by the blade 7*c* can be securely performed. Moreover, in the same manner as the case of the preceding cutting apparatus, the dust and fine powder within the housing 8 can be collected to the collecting unit 5 by pressure of the compression air from the air supply header 8*b* and suction into the suction header 8*c* without being scattered outside the housing 8 thereby giving no adverse effect to the environment.

FIGS. 11 to 22 show a preferred embodiment of a cutting and grooving apparatus for pavement in accordance with the invention stated in claims 8 to 17.

Figure 11:
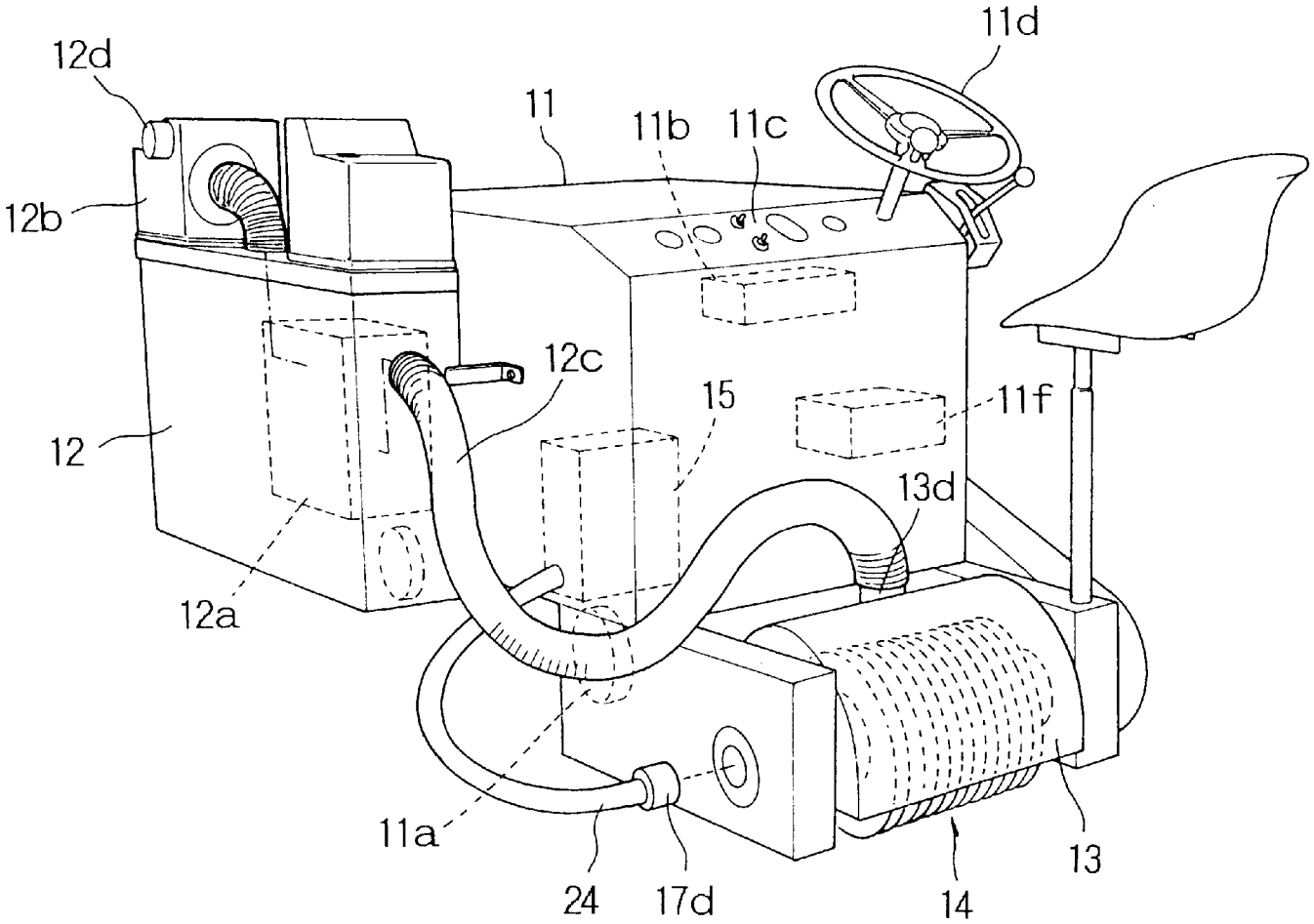
FIG. 11 is a schematic view which shows a dry cutting and grooving apparatus for pavement in accordance with an embodiment of the invention which is a grooving apparatus for forming a multiplicity of grooves on the road.

In FIG. 11, a body 11 of the grooving apparatus is a self-propelled type apparatus which an operator rides to operate, and the body 11 is provided with a drive wheel 11*a* for running, an operating table 11*c* with a controller 11*b* and a steering wheel 11*d*. A collecting unit 12 for collecting chips and cutting powder generated during operation and discharging only air is provided on the side of the body 11, and a housing 13 for covering a blade drum 14 and the periphery thereof is provided at the rear of the body 11.

In order to collect chips and cutting powder during cutting pavement by the blade drum 14, a suction system for supplying compressed air and sucking the dust from the housing 13 is connected to the housing 13. The compressed air is supplied by a compressor 15 installed in the body 11, and the dust and air are sucked from the housing 13 by the collecting unit 12 disposed in the opposite side of the body 11. The collecting unit 12 is provided with a collecting chamber 12*a* for collecting the dust in the inner portion thereof, and is structured so as to connect the flow passage from the collecting chamber 12*a* to a suction fan 12*b* disposed on the upper surface thereof. The collecting chamber 12*a* and the housing 13 are connected by a collecting hose 12*c* such as a flexible tube, and the air from the housing 13 is sucked to the collecting chamber 12*a* by operating the suction fan 12*b*, and the air after the dust is collected within the collecting chamber 12*a* is discharged from an exhaust port 12*d* connected to a discharge port of the suction fan 12*b*.

Figure 12:
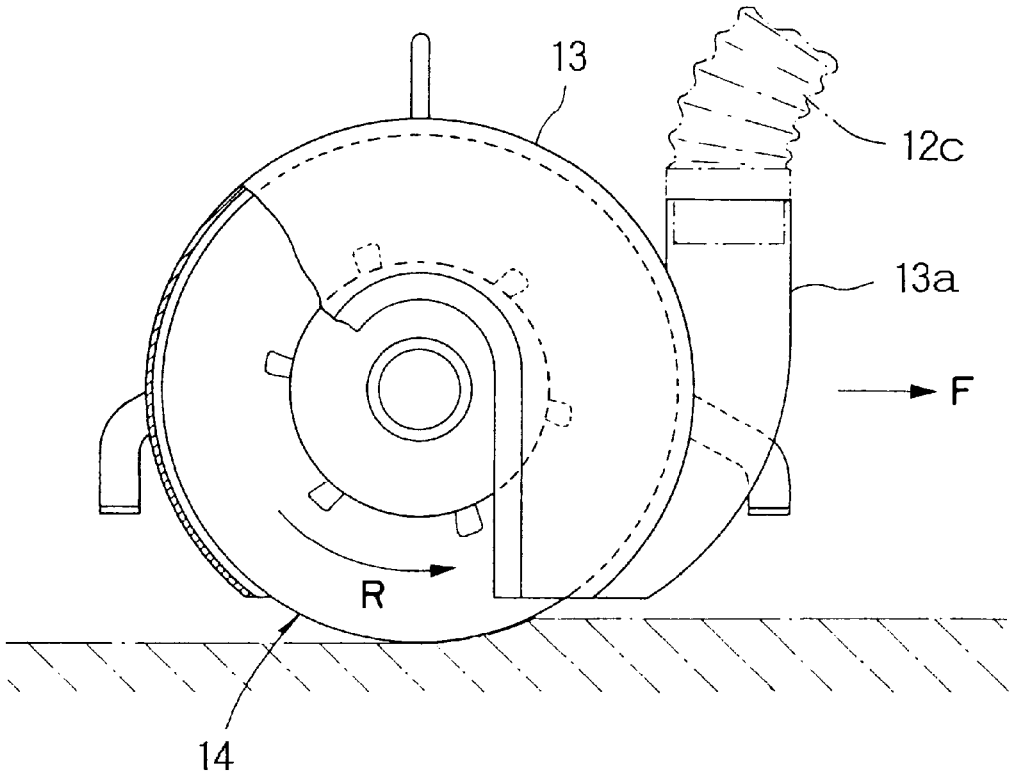
FIG. 12 is a partially sectioned side elevational view which shows an arrangement between the housing and the blade drum.

The housing 13 has a cross sectional shape in which only the lower side is open as shown in the partially sectioned side view of FIG. 12, and the blade drum 14 is rotatably installed inside the housing 13. On the peripheral surface of the housing 13, a scavenging port 13*a* extends upward from the lower end portion of the housing 13, and the collecting hose 12*c* is connected to the upper end of the scavenging port 13*a*. The single scavenging port 13*a* may be disposed at the center in the width direction of the housing 13, or the two or more scavenging ports 13*a* may be disposed at intervals along the width direction. In other words, the scavenging port 13*a* is disposed so as to sufficiently scavenge the air from the whole inner portion of the housing 13 depending upon the length in the width direction of the housing 13. Thus, when the blade drum 14 is rotated in the direction of an arrow R in the drawing, the air flow induced by the rotation of the blade drum 14 can be smoothly introduced by the scavenging port 13*a* which extends upward along the line tangent to the rotating direction of the blade drum 14.

Figure 13:
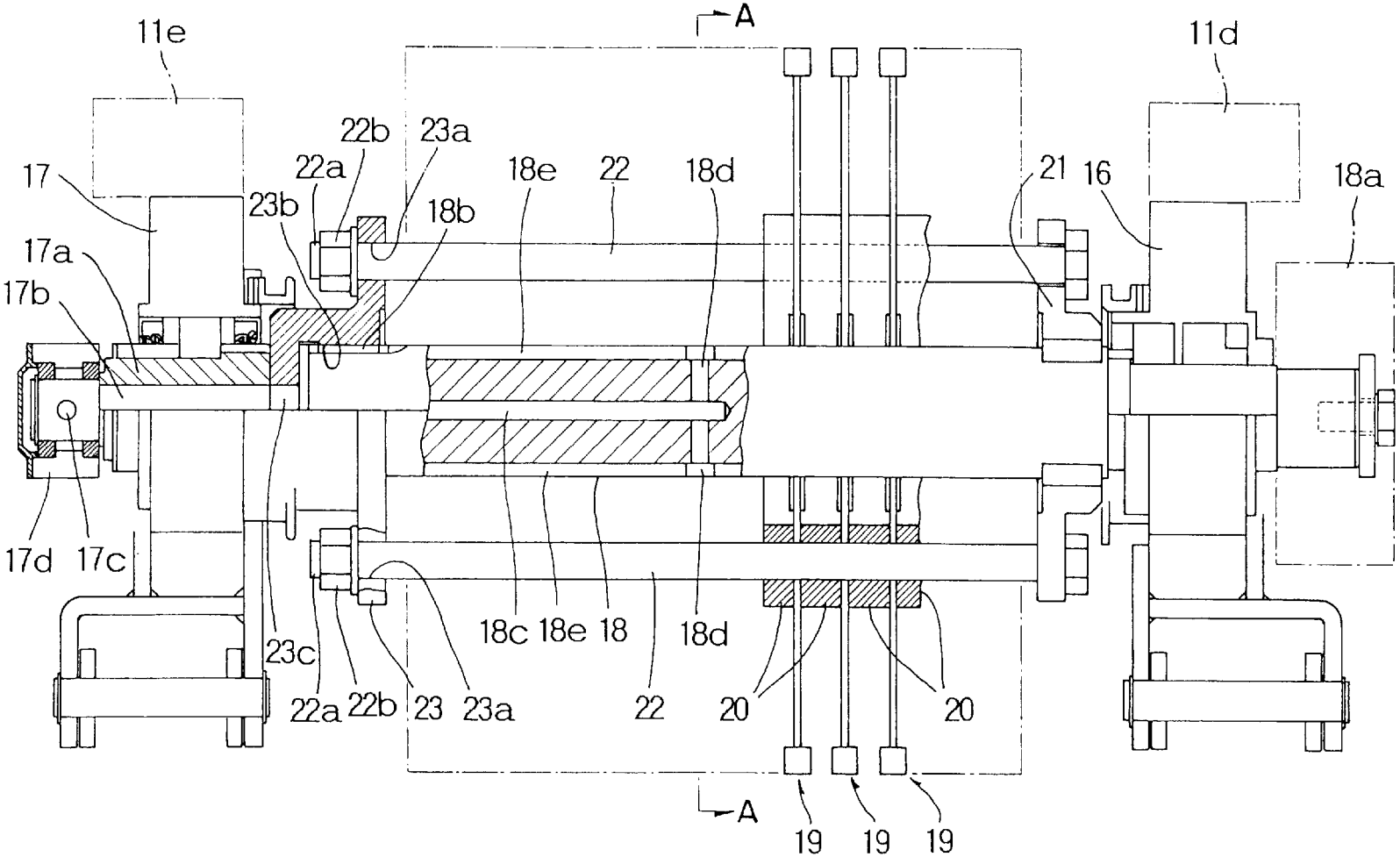
FIG. 13 is a partially sectioned front elevational view which shows a main portion of the blade drum including a connecting structure to a frame of the apparatus.
Figure 14:
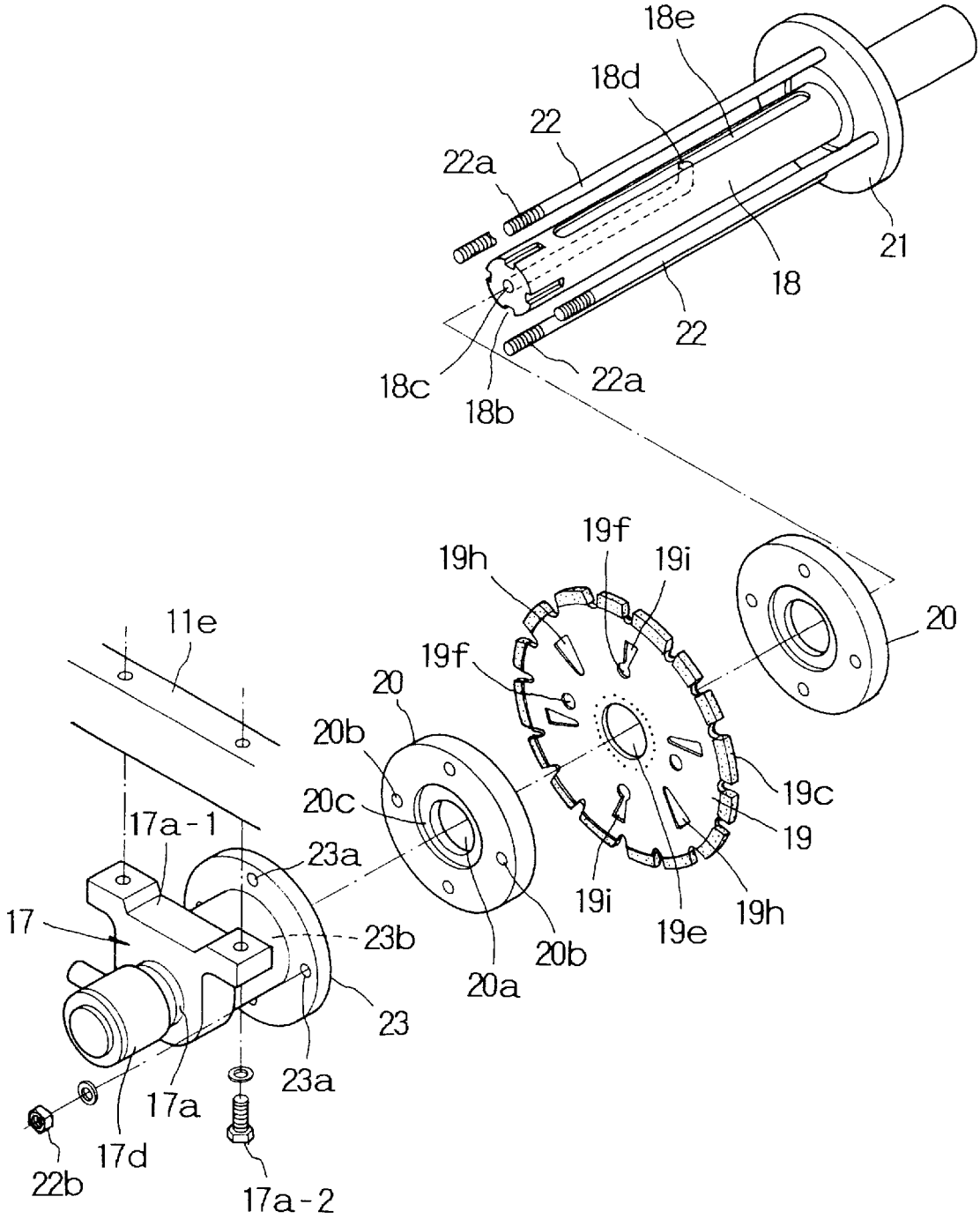
FIG. 14 is an exploded perspective view which shows a main portion including the blade drum.

FIG. 13 is a partially sectioned front view showing a detailed structure of a main portion of the blade drum 14 together with a connecting structure to the body 11, and FIG. 14 is an exploded perspective view of a main portion.

The blade drum 14 is supported by bearings 16 and 17 fixed to each of a pair of frames 11*e* provided in the body 11, and is provided with a main shaft 18, a blade member 19 and a spacer 20. A flange 21 is fixed to an end of the main shaft 18. In this embodiment, the blade member 19 corresponds to an element as a rotating blade in the invention.

The main shaft 18 projects the end portion thereof from the portion that the flange 21 fits outside and is fixed to, and has the length extending through the bearing 16, and is integrally provided with a driven wheel 18*a* connected to a driving apparatus 11*f* (FIG. 11) disposed within the body 11 in the shaft end. The driven wheel 18*a* may be a sprocket when the kinematic chain means from the driving apparatus 11*f* is a chain, or may be a pulley when the kinematic chain means is a belt. Further, the flange 21 is structured so as to position the axial direction of the main shaft 18 by connecting the right end surface in FIG. 13 of the flange 21 to the bearing 16, and mounts four connecting rods 22 in parallel to the main shaft 18. These connecting rods 22 are arranged around the main shaft 18 at an angular pitch of 90°, and a male screw 22*a* is formed in the distal end of each of the connecting rods.

Further, a spline 18*b* is formed on an outer periphery of an end portion in which the main shaft 18 faces the bearing 17, and a supply passage 18*c* for supplying air is provided in an axial direction from the end surface on the side in which the spline 18*b* is provided. Two flow outlet ports 18*d* formed into a T-shape and opening to an outer peripheral surface end are provided in a terminal end of the supply passage 18*c*, and further, a flow passage groove 18*e* including the flow outlet ports 18*d* is formed on the outer peripheral surface of the main shaft 18. The flow passage groove 18*e* has the length extending from the spline 18*b* portion to the flange 21 portion, as shown in FIG. 14.

A support shaft 17*a* is rotatably assembled in the bearing 17 beforehand, and coaxially mounts the flange 23 in the distal end. A block 17*a*–1 of the bearing 17 can be attached to and detached from the frame lie with a bolt 17*a*–2 as shown in FIG. 14. The bolt 17*a*–2 is disposed at the position in which a tool can be hooked when the housing 13 is detached from the body 11, and the bearing 17 can be easily removed from the body 11 and assembled to the body by simply operating the bolt 17*a*–2.

The flange 23 can be integrally rotated with the support shaft 17*a*, and is provided in order to dispose four apertures 23*a* for inserting the four connecting rods 22. A receiving seat 23*b* is recessed for engaging the inserted spline 18*b* of the main shaft 18, and a flow passage 23*c* is opened in the center of the receiving seat 23*b*, which corresponds with a supply passage 18*c* of the main shaft 18.

The support shaft 17*a* has the length projecting from the end portion of the bearing 17, and the position in the axial direction thereof is restricted by the radial/thrust bearing 17. A communication passage 17*b* corresponding with the flow passage 23*c* of the flange 23 is formed throughout the length in the axial direction, and an flow inlet port 17*c* opening to an outer peripheral surface is provided on one end of the communication passage 17*b*. Further, a swivel joint 17*d* is rotatably connected to the distal end portion of the support shaft 17*a* so as to communicate the internal flow passage with the flow inlet port 17*c*.

The swivel joint 17*d* has a conventional structure, and is provided with a mechanism which always keeps communication with the flow inlet port 17*c* even when the support shaft 17*a* rotates when the swivel joint 17*d* itself is stopped. The compressed air from the compressor 15 is supplied to the communication flow passage 17*b*, the flow passage 23*c* of the flange 23, the supply passage 18*c* of the main shaft 18 and the flow outlet port 18*d* from the swivel joint 17*d* and the flow inlet port 17*c* of the support shaft 17*a* by connecting the air supply hose 24 connected to the compressor 15 installed in the body 11 to the swivel joint 17*d*.

Figure 15A:
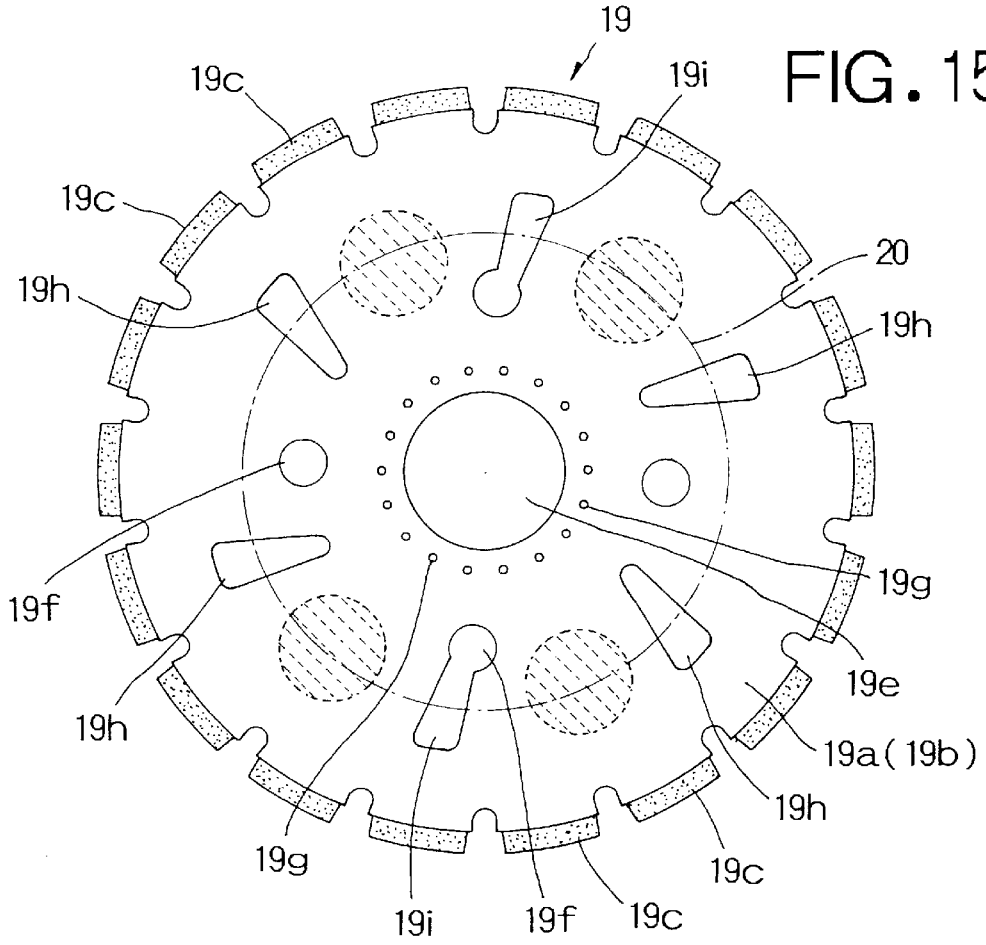
Figure 15B:
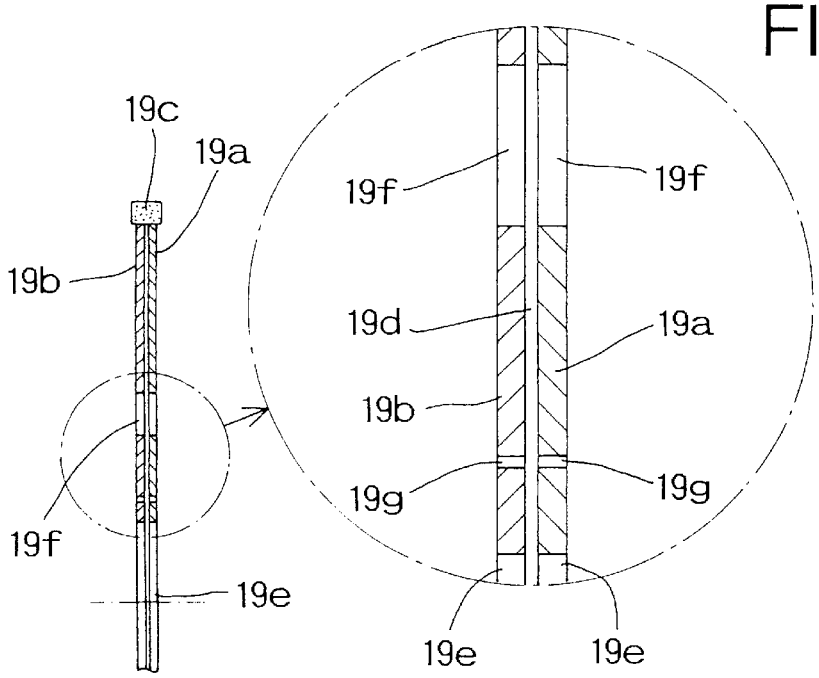

FIGS. 15A and 15B show a detailed structure of the blade member 19, in which FIG. 15A is a front elevational view and FIG. 15B is a vertical cross sectional view of a main portion which is partially enlarged.

In the blade member 19, two base plates 19*a* and 19*b* overlap with a space, and a tip 19*c* containing segment-type diamond abrasive grains on the outer peripheral surface of the base plates 19*a* and 19*b* is integrally bonded. The base plates 19*a* and 19*b* are connected by welding at spots in, for example, circular areas shown by broken lines in FIG. 15A, and a hollow portion 19*d* is formed in the area other than the welding portion as shown in FIG. 15B.

An attachment aperture 19*e* having an inner diameter significantly larger than the outer diameter of the main shaft 18 is formed on the base plates 19*a* and 19*b*, and four attachment apertures 19*f* for inserting the connecting rod 22 are provided. Further, a plurality of flow inlet openings 19*g* having a small inner diameter are coaxially disposed around the attachment aperture 19*e*. Four flow outlet openings 19*h* extending to the outer peripheral edge from a portion corresponding to the diameter of the arrangement pitch circle of the attachment aperture 19*f* are provided. In the illustrated embodiment, a flow outlet opening 19*i* is formed with respect to the two attachment apertures 19*f*.

The spacer 20 is a member which holds an interval between the blades 19, and firmly fixes the blade member 19 between the flanges 21 and 23 on the main shaft 18 and the support shaft 17*a*, respectively. The spacer 20 has an attachment aperture 20*a* fitting outside the main shaft 18 and four attachment apertures 20*b* for passing the connecting rod 22 as shown in FIG. 14. A recessed portion 20*c* is provided around the attachment aperture 20*a* by making the wall thickness small. A size of the spacer 20 is so structured that all of the flow inlet openings 19*g* are included in the range of the recessed portion 20*c* when the spacer 20 overlaps with the blade member 19, and the flow outlet opening 19*h* outward projects from the outer periphery of the spacer 20, as shown in FIG. 16 (a vertical cross sectional view taken along the line A—A of FIG. 13).

Figure 16:
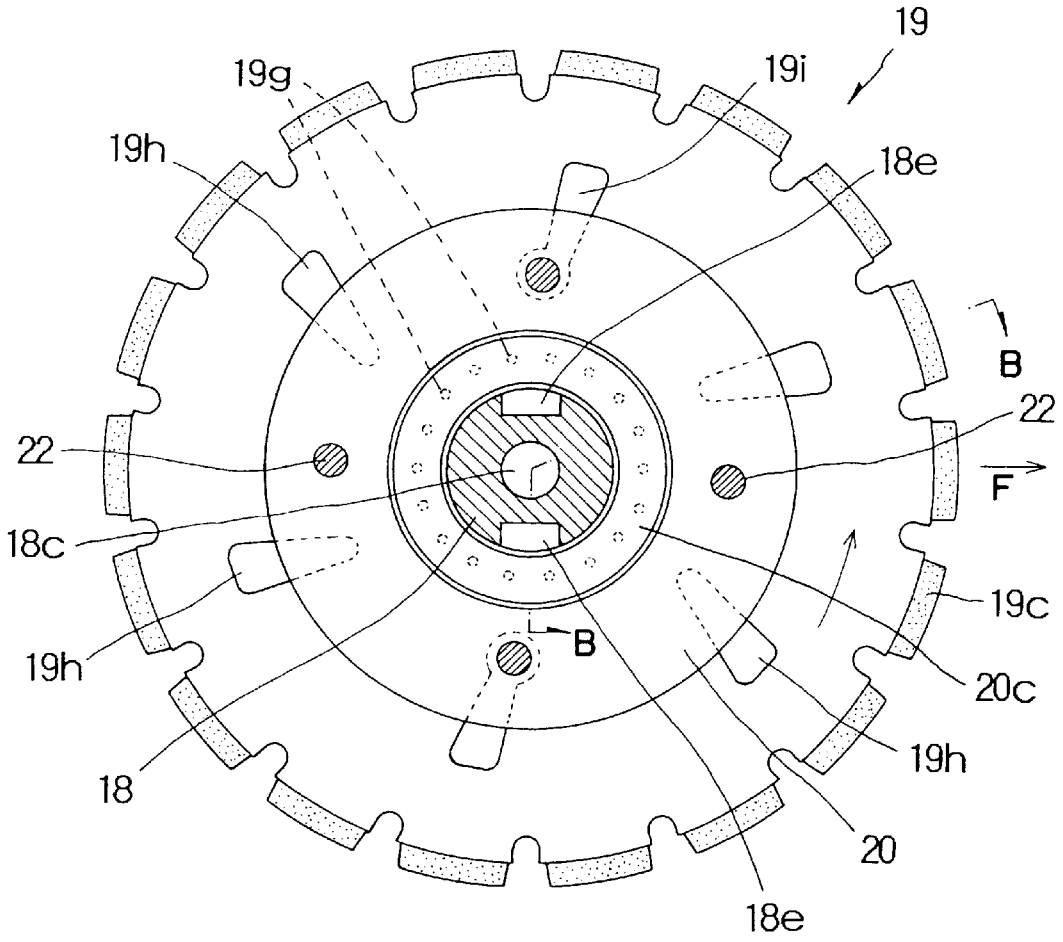
FIG. 16 is a cross sectional view taken along the line A—A in FIG. 13.
Figure 17:
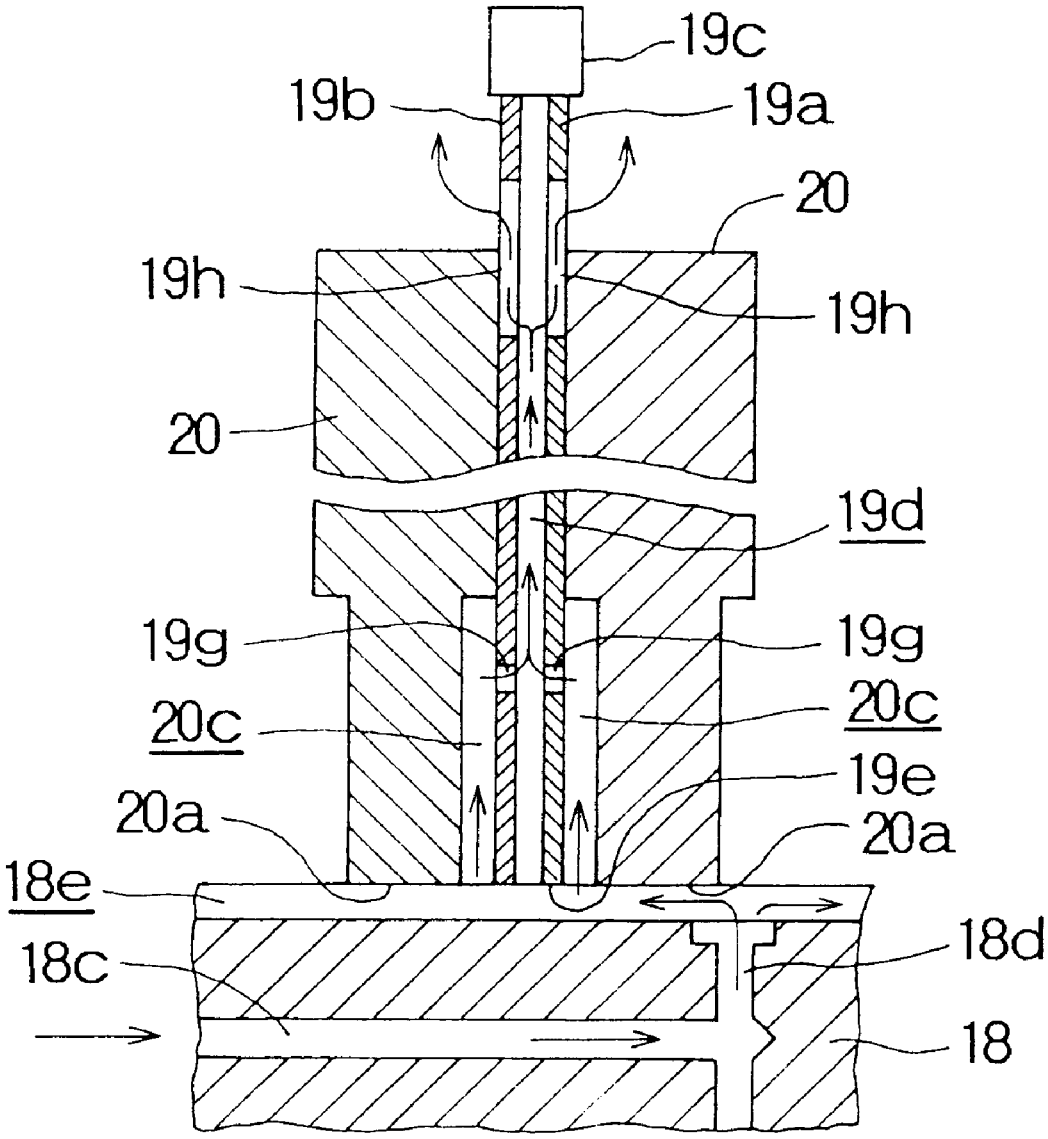
FIG. 17 is a cross sectional view taken along the line B—B in FIG. 16.

FIG. 17 is a cross sectional view taken along the line B—B in FIG. 16.

When the blade member 19 and the spacer 20 are tightly arranged between the flanges 21 and 23 as shown in FIG. 13, the inner peripheral surfaces of the attachment apertures 19*e* and 20*a* cover all of the outer peripheral surface of the main shaft 18. Since the flow passage groove 18*e* is formed on the outer periphery of the main shaft 18, the flow passage groove 18*e* communicates with the space formed by the blade member 19 and the recessed portion 20*c* of the spacer 20 disposed adjacent thereto. Since the space is formed in the range which is occupied by the recessed portion 20*c*, the flow inlet opening 19*g* positioned in such a manner as to be included within the recessed portion 20*c* also communicates with the flow passage groove 18*e*. Accordingly, the hollow portion 19*d* within the blade member 19 communicates with the supply passage 18*c* of the main shaft 18, and the compressed air from the compressor 15 of the body 11 is fed to the hollow space 19*d* so as to be discharged from the flow outlet openings 19*h* and 19*i* opening outward the outer peripheral surface of the spacer 20.

In the structure mentioned above, after adjusting the height so that the blade member 19 forms a suitable cutting in the pavement, the driving apparatus 11*f*is driven by the operating table 11*c*, and the blade drum 14 is rotated while running the body 11. At this time, as shown in FIG. 12, a running direction of the body 11 is the direction shown by an arrow F in the drawing, and a rotating direction of the blade drum 14 is the direction of an arrow R. Accordingly, since the blade drum 14 is rotated so as to blowing the cutting powder to the same direction as the running direction of the body 11, the blade drum 14 is rotated in the direction opposite to the rotating direction of the drive wheel 11*a*.

By the rotation of the blade drum 14, the cutting operation of simultaneously inserting a plurality of blades 19 into the pavement and taking out is repeated, and chips and cutting powder generated by this cutting are sucked to the scavenging port 13*a* disposed in the housing 13. Accordingly, since the collecting unit 12 is connected to the housing 13 by the collecting hose 12*c*, the air within the housing 13 is sucked together with chips and cutting powder due to the suction force of the suction fan 12*b*, so that the chips and cutting powder are not scattered.

During the above operation, the compressed air is supplied from the compressor 15, is discharged from the flow outlet openings 19*h* and 19*i* of the respective blades 19 as previously mentioned, and is radially diffused as a flow along the surface of the base plates 19*a* and 19*b* of the blade member 19. Accordingly, since the blade member 19 is rotated at a high speed, the air flow from the flow outlet openings 19*h* and 19*i* is affected by centrifugal force including the hysteresis of the internal flow within the hollow portion 19*d* and directed to the outer periphery of the blade member 19. Even when the flow outlet openings 19*h* and 19*i* are formed on the side surface of the blade member 19, the air flow flowing out therefrom is fed out as a forcible stream to the outer periphery of the blade member 19, that is, the direction of the tip 19*c*.

Since the air is fed to the tip 19*c* end as mentioned above, the air flow can be effectively supplied to the tip 19 portion in which chips and cutting powder are adhered and floating so that the air flow can be directed to the outer peripheral edge of the blade member 19 in the radial direction. Accordingly, the air flow in the housing 13 is uniformed by diffusing toward the radial direction of each of the blades 19. As shown in FIG. 12, since the blade drum 14 is rotated to face the scavenging port 13*a* immediately after passing through the cutting point, chips and cutting powder from the cutting point are urged by the diffusing air flow from the flow outlet openings 19*h* and 19*i* and, at the same time, receive suction force toward the scavenging port 13*a*. Accordingly, the dust generated within the housing 13 can be efficiently collected through the scavenging port 13*a*, and thus the desirable environment can be obtained free from the dust scattered outside.

Further, since the air flow from the flow outlet openings 19*h* and 19*i* is diffused toward the tip 19*c*, the air flow can also be utilized for cooling the tip 19*c* portion. Namely, since the air is discharged from both surfaces of each of the blades 19 toward the tip 19*c* portion, the tip 19*c* heated by the repeated contact with the pavement can be cooled by the air flow. Therefore, durability of the tip 19*c* can be improved and high cutting performance can be maintained, leading to the greater efficiency in operation.

When the tip 19*c* is worn or the blade member 19 is broken, the blade member 19 is replaced while the main shaft 18 is left in the body 11. Specifically, the housing 13 is removed from the body 11, and the nut 22*b* is removed from the connecting rod 22 as shown in FIG. 14. Then, the bearing 17 supporting the support shaft 17*a* is removed from the frame lie. The bearing 17 can be removed only by rotating and taking out the bolt 17*a*–2, and the flange 23 and the main shaft 18 which are only engaged with each other by the spline 18*b* after removing the nut 22*b*, can be separated by removing the bearing 17 from the main shaft 18.

The status of the main shaft 18 after the bearing 17 is removed is shown in FIG. 14. Each distal end of the main shaft 18 itself and the connecting rod 22 is free. Accordingly, the attached blade member 19 and spacer 20 are taken out, and the blade member 19 is replaced by new ones. Then, the blade member 19 and the spacer 20 are alternately arranged and assembled again as shown in FIG. 13. Subsequently, the bearing 17 is mounted to the frame 11*e* in the reverse procedures to the dismantling, thereby completing the replacement of the blade member 19.

As mentioned above, since the blade member 19 can be replaced while the main shaft 18 to which the blade drum 14 is attached is left in the body 11 of the apparatus, it is sufficient only to remove the combining member of the bearing 17 and the flange 23 even in the construction site. Thus, the operation load is lightened. Accordingly, the time needed for replacement can be shortened, and the efficiency of grooving operation can be improved.

Figure 18:
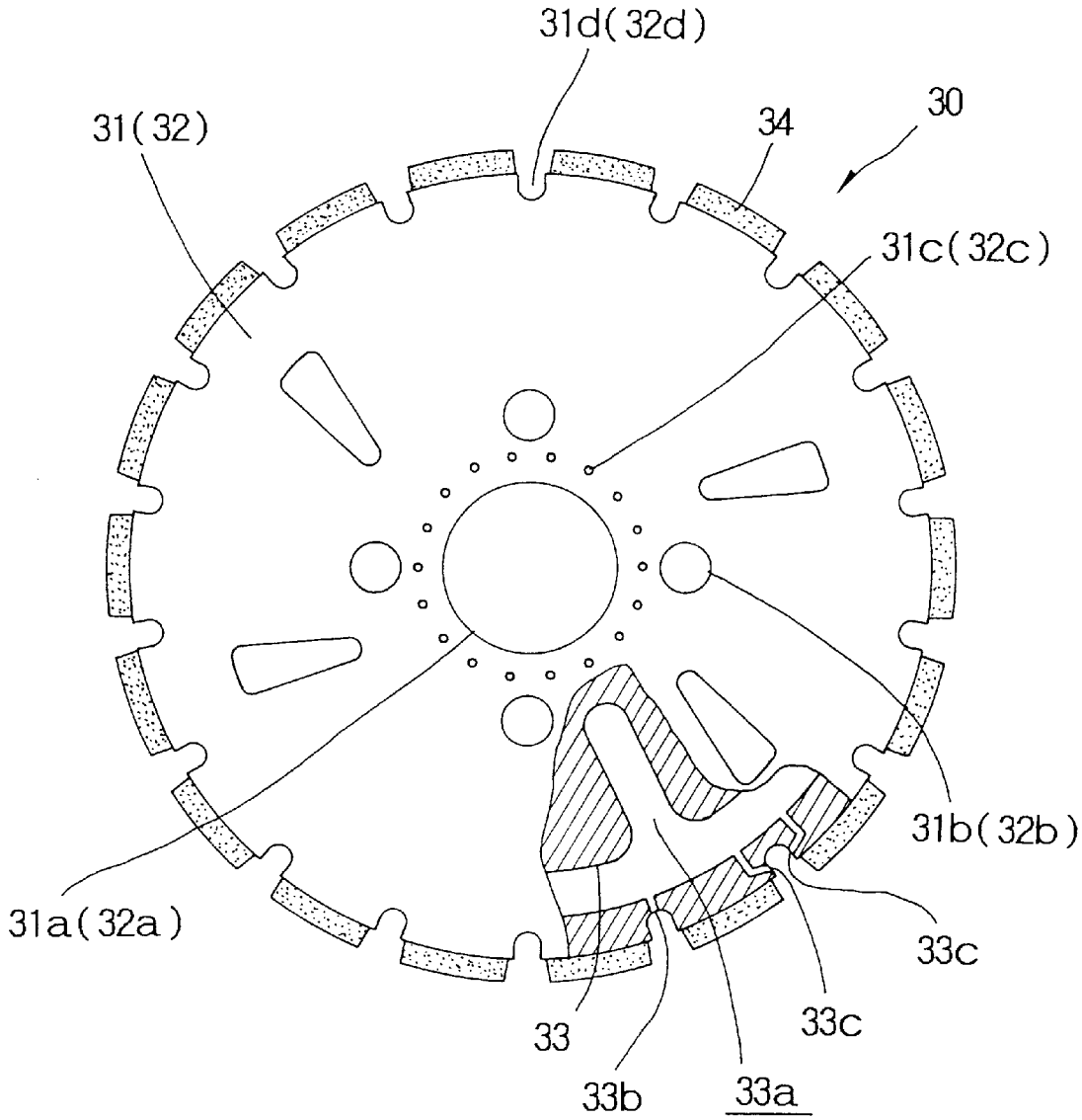
FIG. 18 is a partially sectioned front elevational view which shows the blade where air can be discharged from a segment notch portion of a base plate of the blade.
Figure 19A:
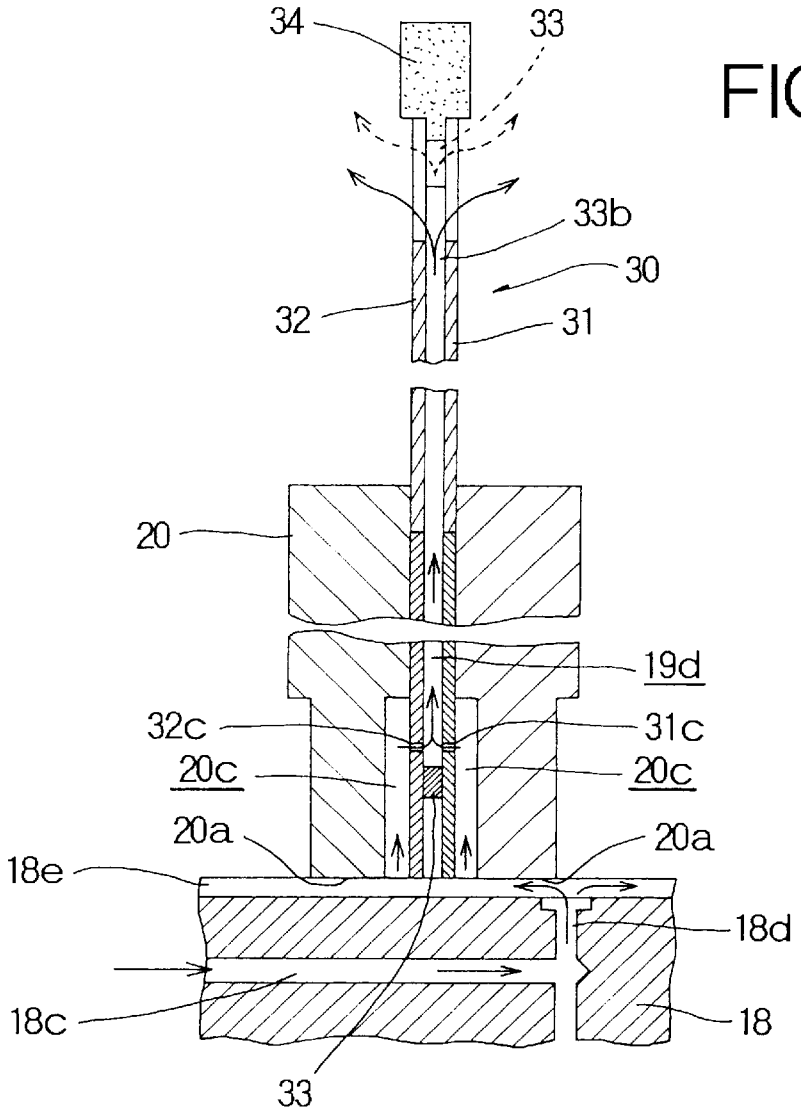
Figure 19B:
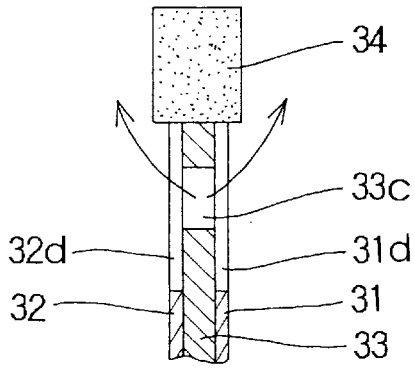

FIGS. 18 to 20 show another embodiment of a structure for discharging air from the blade. In this case, the structure for assembling the main shaft and the spacer is the same as that of the preceding embodiment, and the same and common reference numerals are attached to the same elements.

As shown in FIG. 19, the blade 30 comprises two base plates 31 and 32 which sandwich a pattern plate 33 between them, and a segment-type tip 34 is provided on the outer periphery of the base plates 31 and 32. The base plates 31 and 32 are provided with the attachment apertures 31*a* and 32*a* for passing the main shaft 18, the apertures 31*b* and 32*b* for passing the connecting rod 22 and the flow inlet openings 31*c* and 32*c* arranged so as to be included in the area of the recessed portion 20*c* of the spacer 20, as in the same manner as that of the preceding embodiment.

Figure 20A:
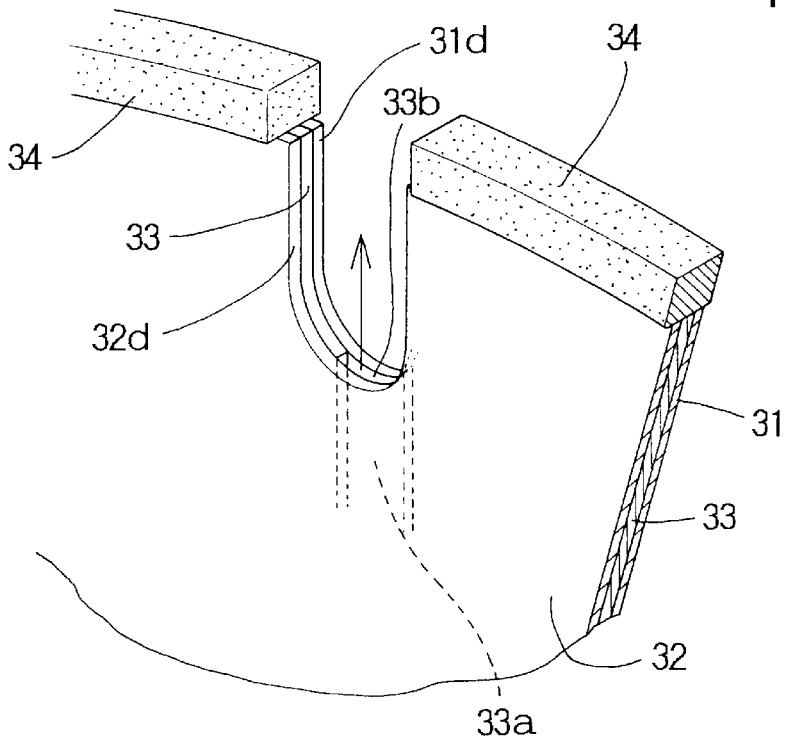
Figure 20B:
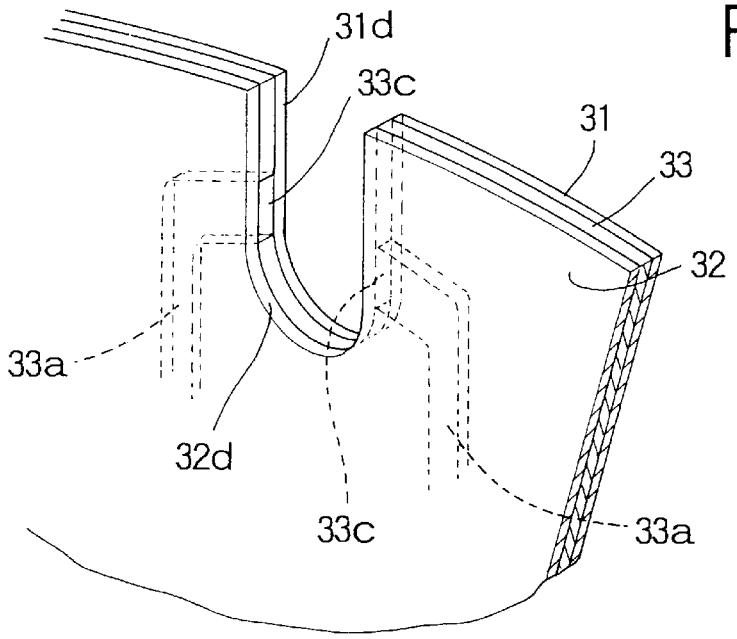

The pattern plate 33 is a member for introducing air to the outer peripheral edge of the base plates 31 and 32 from the flow inlet openings 31*c* and 32*c* with keeping an interval between the base plates 31 and 32. Accordingly, the pattern plate 33 forms a notch 33*a* which extends from the portion included in the area of the recessed portion 20*c* of the spacer 20 to the outer peripheral edge, as shown in FIG. 18 in a partly sectioned view, and the gap between the base plates 31 and 32 formed by the notch 33*a* is an air flow passage from the flow inlet openings 31*c* and 32*c*. Further, a first discharge port 33*b* opening to a radial direction as shown in FIG. 20A and a pair of second discharge ports 33*c* facing each other in a circumferential direction as shown in FIG. 20B are formed in the portion in which the notch 33*a* faces the segment notches 31*d* and 32*d* of the outer peripheral edge of the base plates 31 and 32.

In this case, the first discharge port 33*b* and the second discharge port 33*c* are formed to be alternately arranged in the segment notches 31*d* and 32*d* of the base plates 31 and 32. Accordingly, the adjacent segment notches 31*d* and 32*d* are arranged as a combination of the ports for discharging air to the radial direction and to the circumferential direction.

In this structure, the compressed air from the supply passage 18*c* of the main shaft 18 is supplied to the notch 33*a* of the pattern plate 33 from the flow inlet openings 31*c* and 32*c* of the portion included in the recessed portion 20*c* of the spacer 20, as shown in FIG. 19. Since the notch 33*a* communicates with the first discharge port 33*b* and the second discharge port 33*c* as shown in FIGS. 20A and 20B, the supplied air is discharged from the first and second discharge ports 33*b* and 33*c*.

By discharging the air in this manner, the air flow can be efficiently supplied to the portion in which chips and cutting powder are adhered or floating as in the same manner as that of the preceding embodiment. Thus, the dust generated within the housing 13 can be efficiently collected through the scavenging port 13*a*. Further, since the air is discharged from the portion of the segment notches 31*d* and 32*d* near the tip 34, the effect of cooling the tip 34 can be further improved in comparison with the case of the preceding embodiment.

Figure 21:
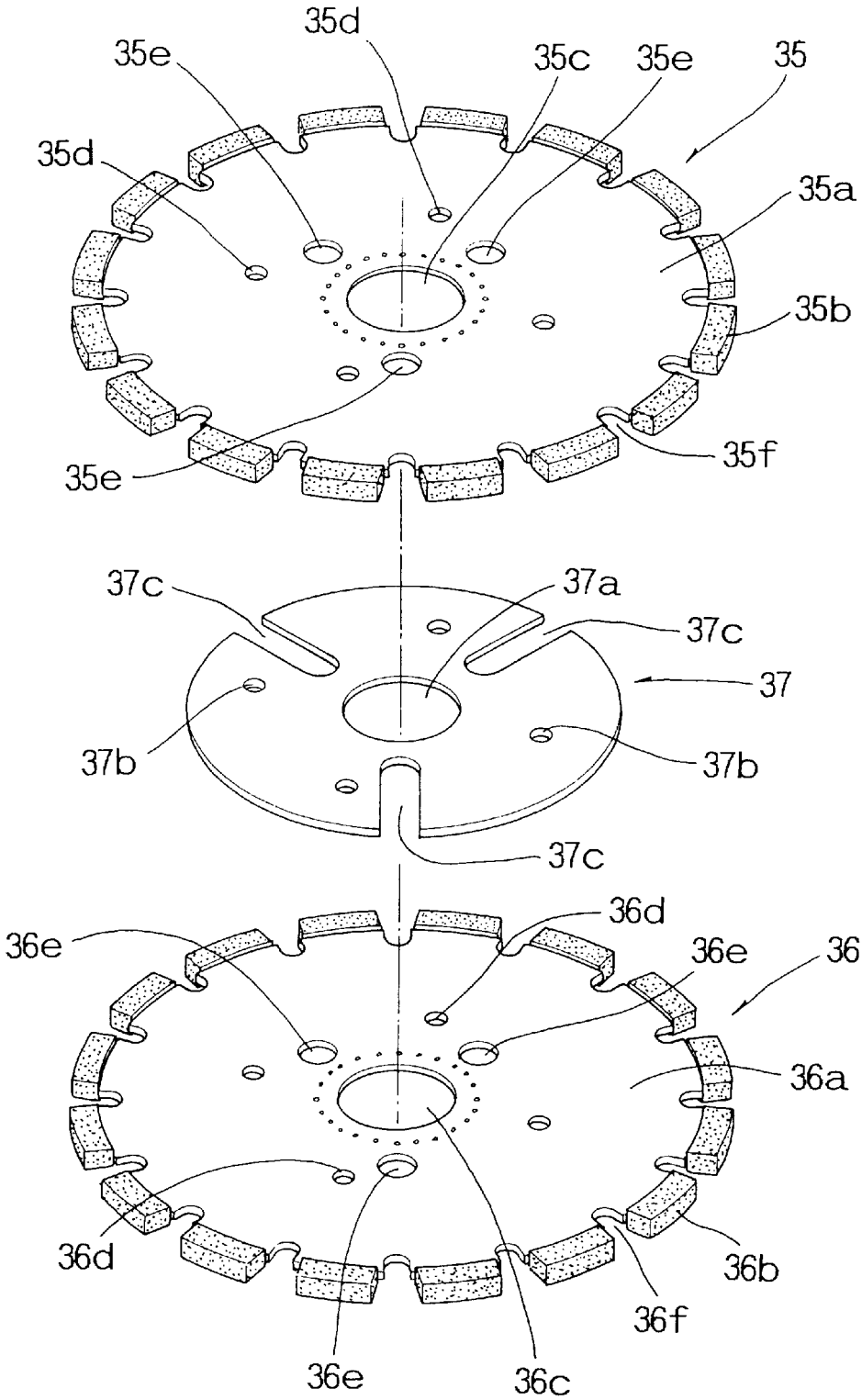
FIG. 21 shows an exploded perspective view which shows an embodiment of layering two blades by a spacer plate.
Figure 22A:
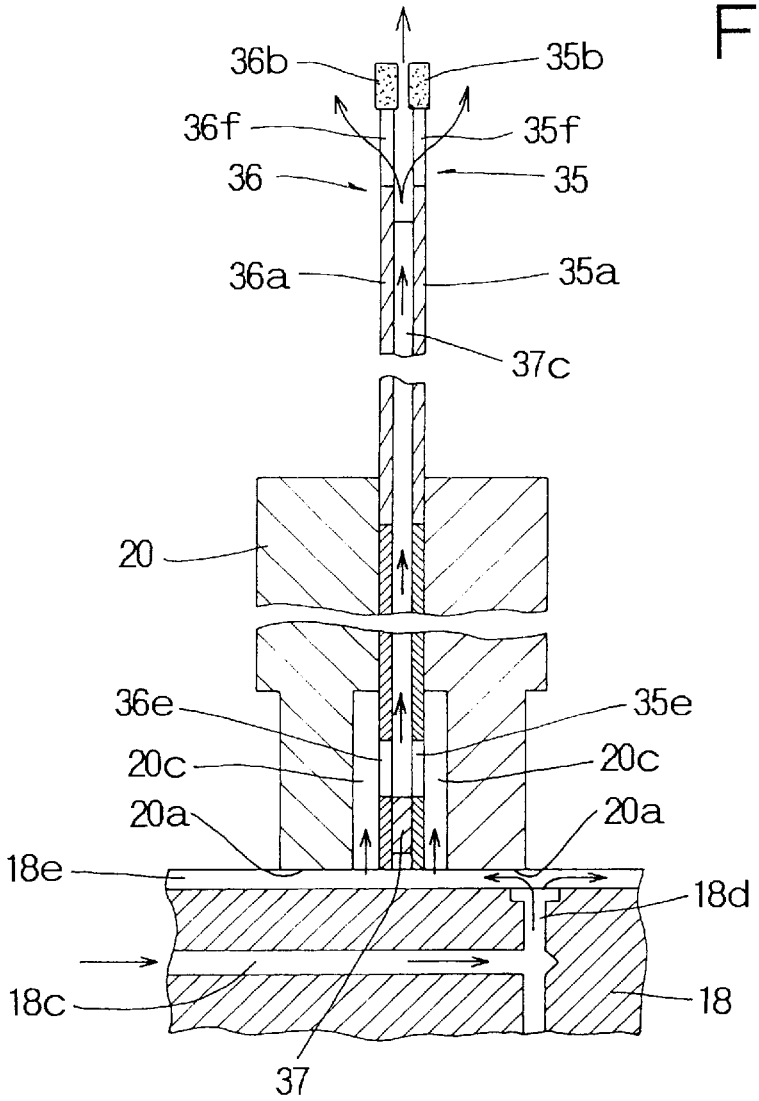
Figure 22B:
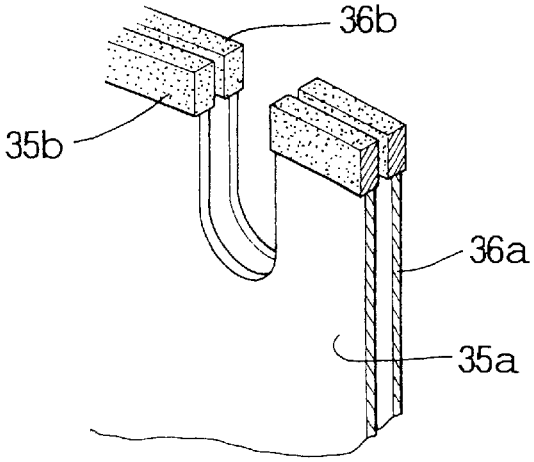
Figure 23:
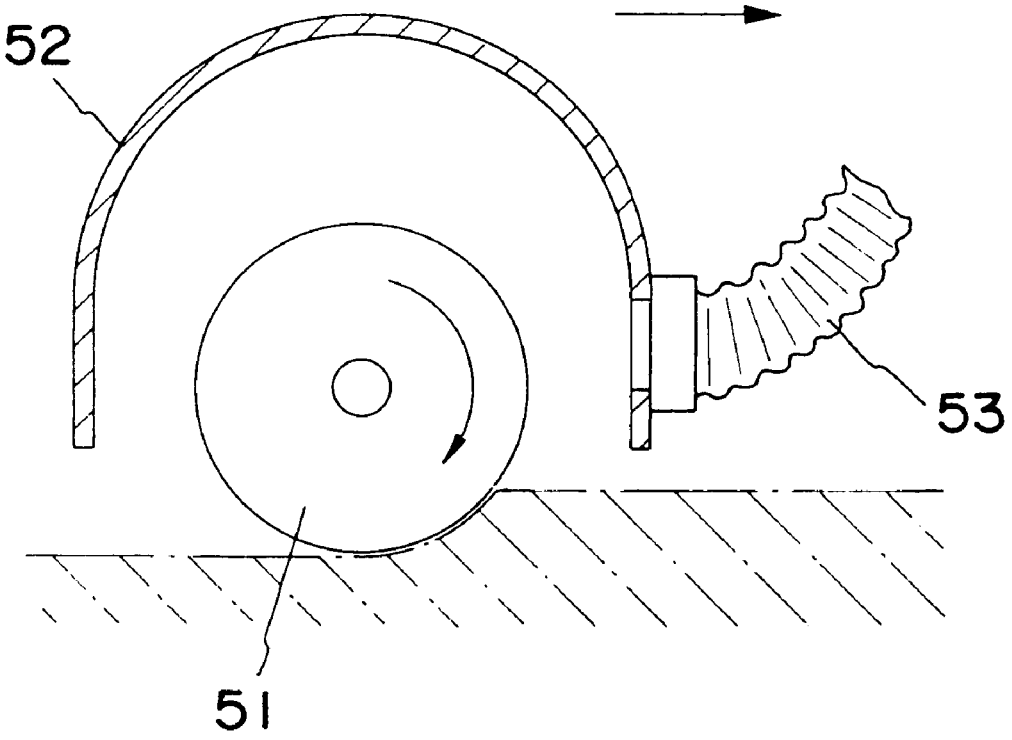
FIG. 23 is a schematically vertical cross sectional view which shows a main portion in accordance with the prior art.

FIGS. 21 and 22 show the other embodiment of a mechanism for discharging air.

In this embodiment, two blades 35 and 36 and one spacer plate 27 are combined, and the blades 35 and 36 are common members. In accordance with this embodiment, the combination of these blades 35 and 36 constitutes a rotating blade which is a blade layered body.

The blades 35 and 36 are provided with segment-type tips 35*b* and 36*b* on an outer peripheral edge of the base plates 35*a* and 36*a*, and further provided with attachment apertures 35*c* and 36*c* for passing the main shaft 18 and apertures 35*d* and 36*d* for passing the connecting rod 22, respectively. Three flow inlet openings 35*e* and 36*e* are formed within the area included in the recessed portion 20*c* of the spacer 20.

The spacer plate 37 has a thickness capable of layering the blades 35 and 36 at a degree of forming a slight or no gap between the tips 35*b* and 36*b* as shown in FIG. 22. An attachment opening 37*a* and an opening 37*b* for passing the main shaft 18 and the connecting rod 22, respectively, are provided in the spacer plate 37, and further, three notches 37*c* for the flow passage is formed in a radial direction. These notches 37*c* are so structured that the base end close to the center of the spacer plate 37 can correspond with the flow inlet openings 35*e* and 36*e* of the blades 35 and 36. As shown in FIG. 22A, a hollow flow passage by the notch 37*c* is formed between the blades 35 and 36 in relation to the thickness of the spacer plate 37.

In this embodiment, an outer diameter of the spacer plate 37 is short at a degree of not interfering with the bottom of the segment notches 35*f* and 36*f* of the blades 35 and 36. Accordingly, a gap is formed between the blades 35 and 36 outside the outer periphery of the spacer plate 37, and the air from the openings of the three notches 37*c* spreads out over the outer peripheral edge of the blades 35 and 36.

In the above combination of the two blades 35 and 36, as shown in FIG. 22A, the air from the main shaft 18 is supplied to the notch 37*c* of the spacer plate 37 from the flow inlet openings 35*e* and 36*e*, and is discharged to the outer peripheral edge end of the blades 35 and 36 from the hollow flow passage formed by the notch 37*c*. Since the gap is formed between the blades 35 and 36 outside the spacer plate 37, the air from the opening end of the notch 37*c* is mainly discharged from the portion between the segment notches 35*f* and 36*f* of the blades 35 and 36, as shown in FIG. 22A.

As mentioned above, the air can be also supplied to the inner portion of the housing 13 by the combination between the two blades 35 and 36 and the spacer plate 37, thereby eliminating the scattering of the dust. Moreover, since the air is discharged from the position close to the tips 35*b* and 36*b*, the cooling effect thereof can be improved.

What is claimed is:

1. A dry cutting and grooving apparatus for pavement, comprising:

a body having a front end;

a drive disposed in the body;

a rotatable blade for cutting or grooving, operatively connected to be driven by the drive wherein the blade is rotatable in a direction to scrape out and bring up a pavement layer toward a front end of the body;

a housing covering all of the blade except a lower-end portion;

a scavenging assembly for scavenging dust and chips brought up by the blade and disposed in the body, the scavenging assembly having a combination of an air supply assembly and a suction device, the air supply assembly being disposed to feed pressurized air to the blade at an upstream end of the housing, and the suction device being disposed to suck air dust and chips from a downstream end of the housing;

an air flow passage disposed in the blade, communicating with the air supply assembly, to discharge air from the blade;

wherein the blade member further comprises a pair of base plates, each blade having an outer periphery and one or more cutting tips on the outer periphery, wherein the base plates define an interval therebetween in which the air flow passage is disposed, and wherein the air flow passage has at least one opening disposed in the outer periphery of the blade member a shaft operatively connected to the drive and carrying the blade member fixed thereto, wherein the shaft further comprises an air flow passage communicating the air supply assembly with the air passage in the blade member; and wherein said shaft further comprises a swivel joint at one end communicating the air flow passage of the shaft with the air supply assembly.

2. A dry cutting and grooving apparatus for pavement, according to claim 1, further comprising an annular spacer having an outer diameter smaller than an outer diameter of the blade member, fixably provided around the shaft and interposing an interval between adjacent blade members, said spacer having an air flow passage communicating between the air flow passage of the shaft and the air flow passage of the blade member.

3. A dry cutting and grooving apparatus for pavement, according to claim 2, wherein the air flow passage of the shaft includes a flow passage groove disposed on an outer periphery of the shaft and running in an axial direction along the shaft; and wherein the annular spacer has an aperture for fitting around the shaft, and a recessed portion extending radially outward from the aperture so as to define a flow inlet opening communicating with the groove when the spacer and blade are assembled, and communicating with the airflow passage of the blade member.

4. A dry cutting and grooving apparatus for pavement, according to claim 3, further comprising a first bearing fixed to the body and rotatably supporting an end of the shaft operably connected to the drive, and a second bearing rotatably supporting another end of the shaft and removably attached to the shaft and the body.

5. A dry cutting and grooving apparatus for pavement, according to claim 4, further comprising a first flange disposed around the shaft and opposed to the first bearing, a hollow supporting shaft coaxially inserted in the first bearing, wherein the supporting shaft is connected with the swivel joint and is provided with a second flange, the second flange engaging one end of the supporting shaft in a spline combination, and wherein the spacers and blade members are tightly bound between the first and second flanges by pressure loading.

6. A dry cutting and grooving apparatus for pavement, according to claim 5, further comprising a plurality of connecting rods having first ends connected to the first flange and extending parallel to the shaft and having second distal ends detachably connected to the second flange, wherein the connecting rods pass through apertures provided in the blade members and spacers.

* * * * *